US007475947B2

(12) United States Patent
LeBegue

(10) Patent No.: US 7,475,947 B2
(45) Date of Patent: Jan. 13, 2009

(54) EXTENDABLE CUTTER DRUM FOR A BORING MACHINE

(75) Inventor: Maurice K. LeBegue, Bluefield, WV (US)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 11/790,850

(22) Filed: Apr. 27, 2007

(65) Prior Publication Data

US 2008/0217986 A1 Sep. 11, 2008

Related U.S. Application Data

(60) Provisional application No. 60/904,790, filed on Mar. 5, 2007.

(51) Int. Cl.
*E21C 25/08* (2006.01)

(52) U.S. Cl. ..... 299/80.1

(58) Field of Classification Search ..... 299/80.1
See application file for complete search history.

(56) References Cited

U.S. PATENT DOCUMENTS 3,617,093 A 11/1971 Daily
4,076,316 A 2/1978 LeBegue
4,316,635 A 2/1982 LeBegue et al.
4,339,153 A 7/1982 LeBegue et al.
4,489,985 A 12/1984 Kendrick
5,102,199 A 4/1992 LeBegue
5,143,423 A 9/1992 LeBegue et al.
5,722,789 A * 3/1998 Murray et al. ..... 299/79.1
5,921,632 A * 7/1999 LeBegue ..... 299/80.1
6,431,654 B1 8/2002 LeBegue

* cited by examiner

*Primary Examiner*—John Kreck
(74) *Attorney, Agent, or Firm*—Drinker Biddle & Reath LLP

(57) ABSTRACT

A mining machine that includes a rotor assembly disposed on a mobile frame. A cutter drum assembly includes an intermediate drum section and a pair of end drum sections. The end drum sections are drivingly connected by the intermediate drum section. The end drum sections include an axially fixed drum portion and a drum extension that is axially movable on the drive shaft to extend the length of the cutter drum assembly. A hydraulic piston and cylinder arrangement is disposed in shafts supporting the end drum sections, and extends and retracts the drum extension with respect to the fixed drum portion. A torque transfer arrangement is disposed between the fixed and extension drum portions for mutual rotation.

18 Claims, 39 Drawing Sheets

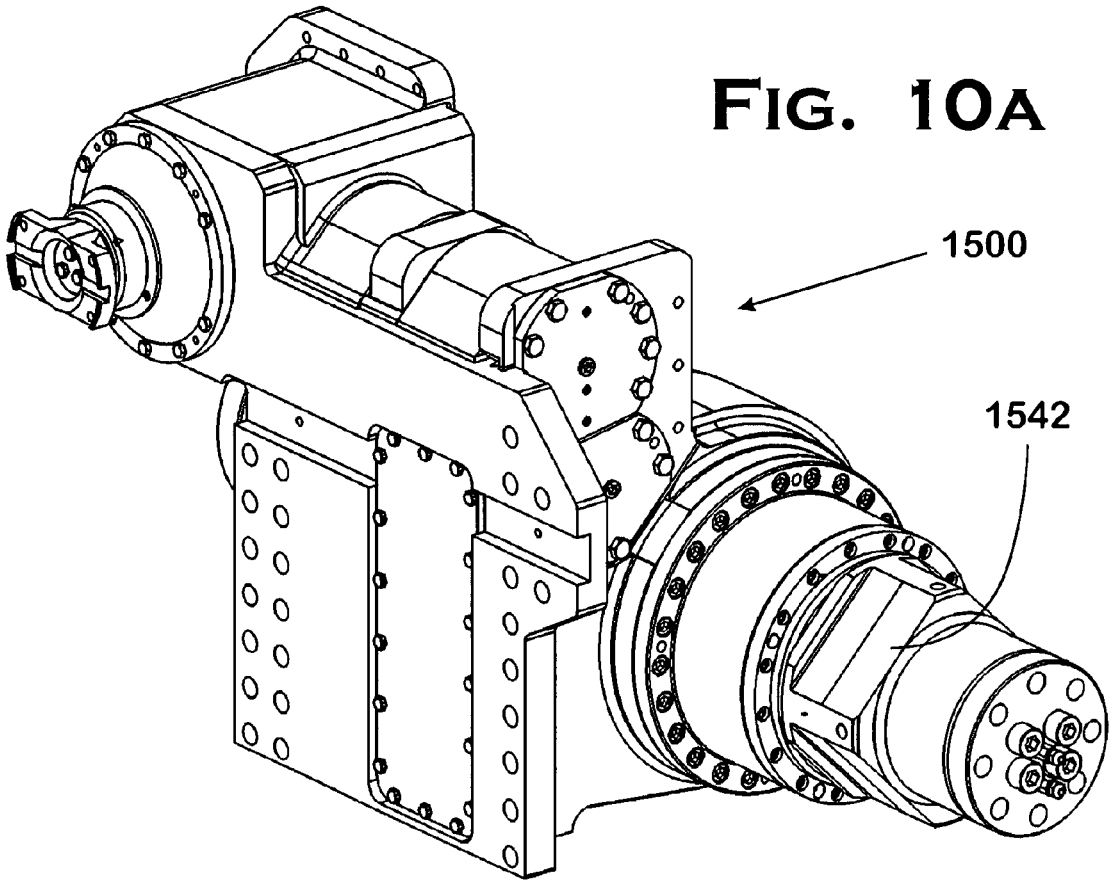
FIG. 10A
FIG. 10B
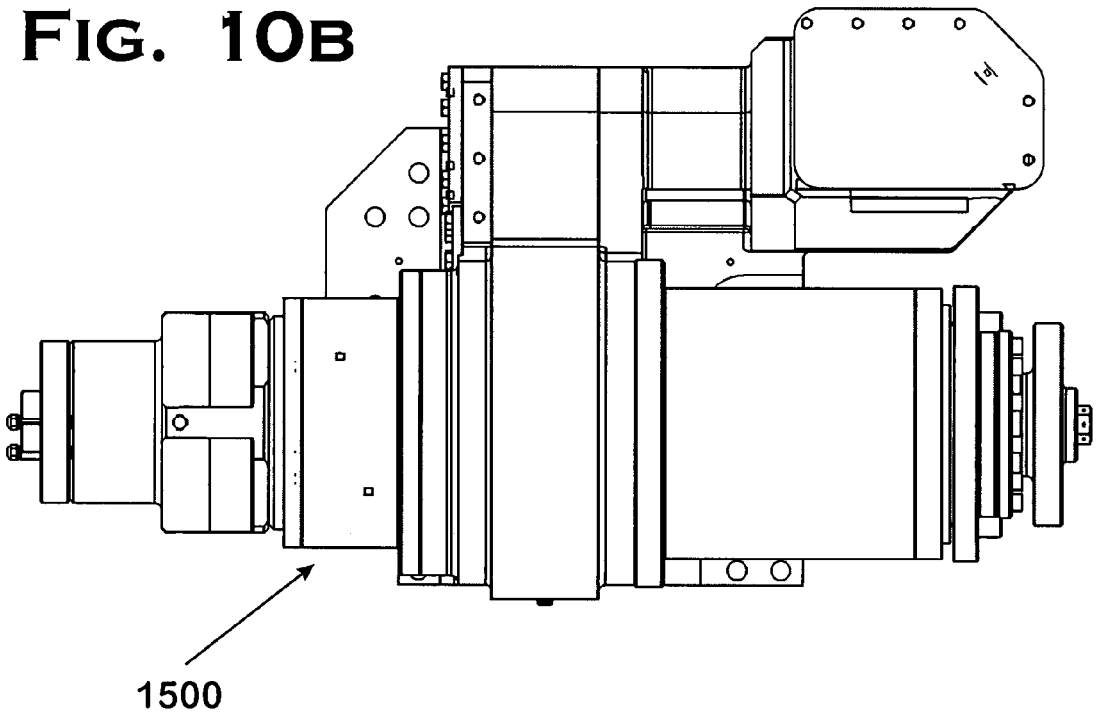

FIG. 10E
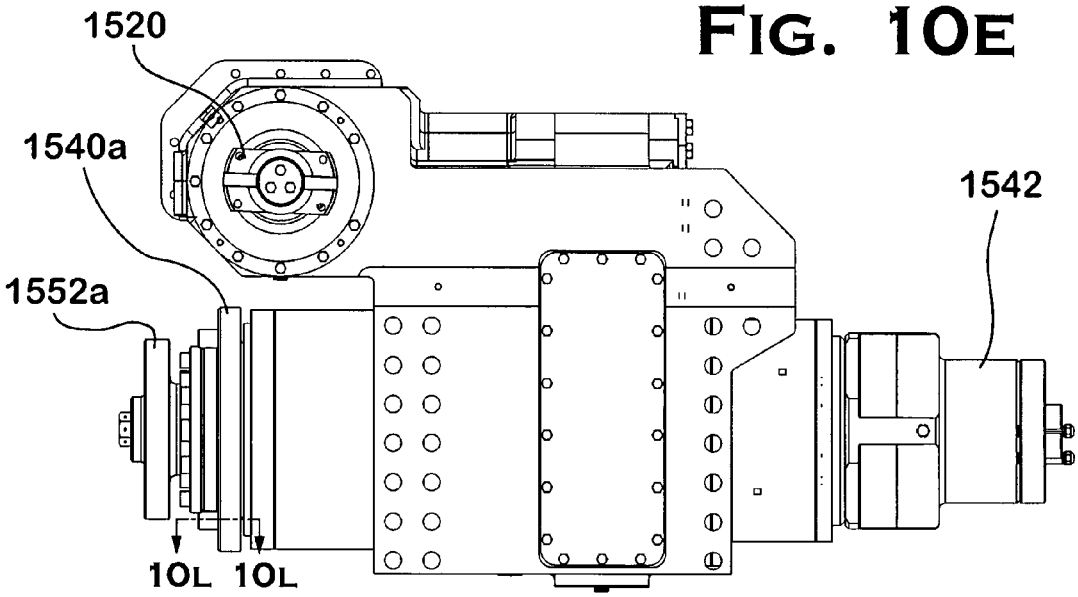
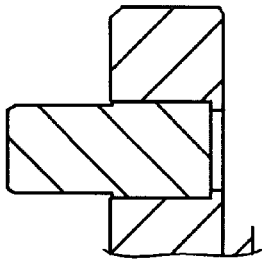
FIG. 10L
FIG. 10F
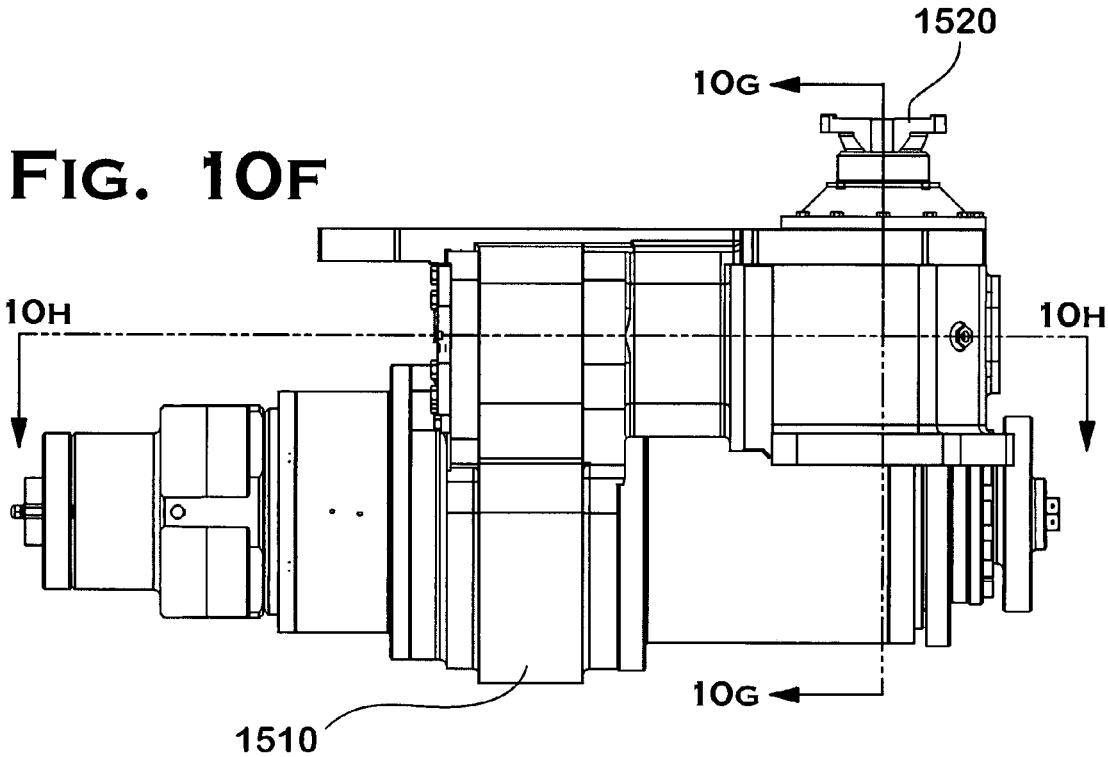

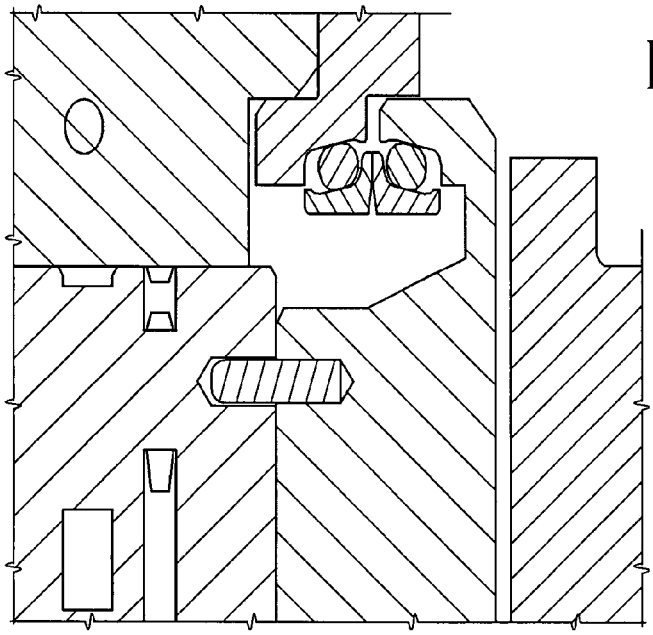
FIG. 11F
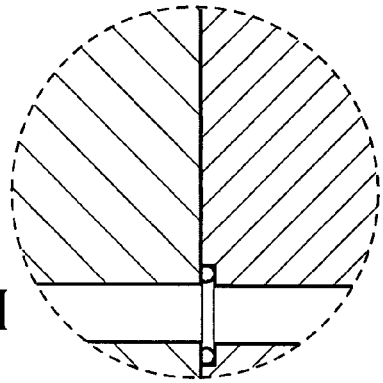
FIG. 11H
FIG. 11G
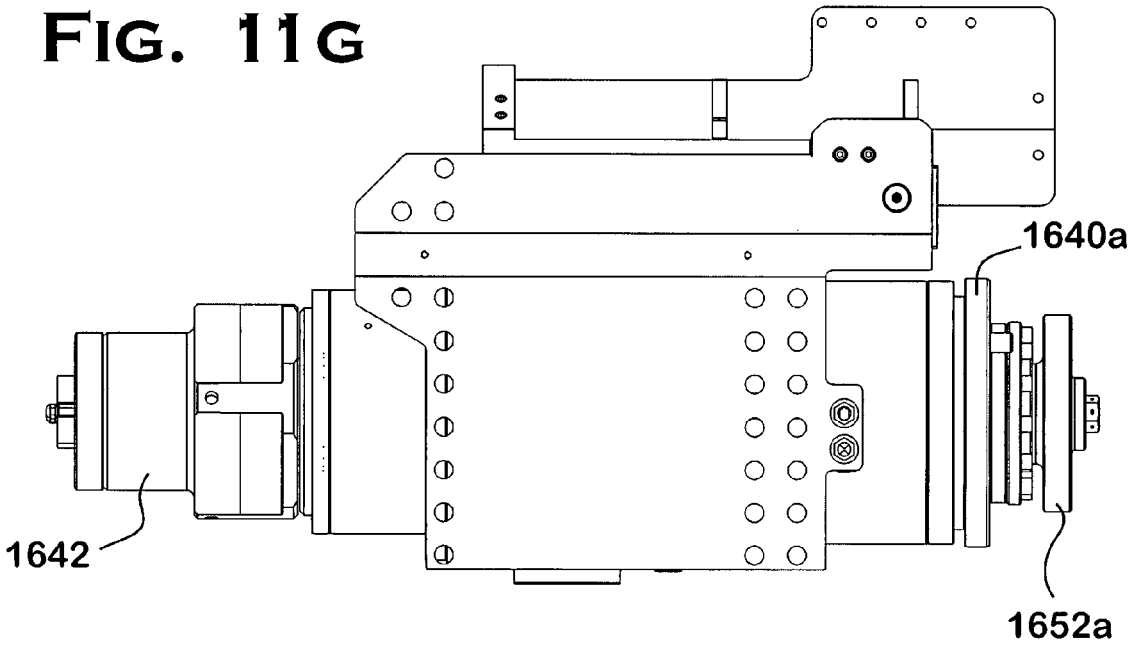

EXTENDABLE CUTTER DRUM FOR A BORING MACHINE

CROSS-REFERENCE TO RELATED APPLICATIONS

This application claims the benefit of U.S. Provisional Patent Application No. 60/904,790, filed on Mar. 5, 2007, the disclosure of which is incorporated by reference herein in its entirety.

BACKGROUND OF THE INVENTION

1. Field of the Invention

This invention relates to a cutter drum assembly for use on a boring type mining machine and, more particularly to a cutter drum having extensible end drums for expanding the cutting width of the cutter drum to dislodge solid material left uncut by the rotor cutter arms from a mine face at the mine roof and floor.

2. Description of Related Art

Related boring machines for underground mining operations typically utilize parallel interlaced rotor arms having cutting elements which cut a generally oval-shaped entry in the mine. Cutter chains or continuous cutter drums are utilized at the roof and floor levels to trim or eliminate cusps left in place because they are out of the cutting paths of the rotor arms. The cutter chain or drum at the mine floor is also used to increase the width of the cut in the mine entry.

To facilitate tramming of the machine into and out of position opposite of the mine face, the lower cutter chain or drum is retracted out of contact with the mine sidewalls and raised out of contact with the mine floor. The upper cutter chain or drum is lowered out of contact with the mine roof.

Other related boring machines also increase the width of the cut at the mine floor beyond the cutting path of the rotor arms by extending the width of the lower cutter drum once its lowered into position on the mine floor at the base of the mine face, e.g., extending the length of a cutter drum assembly on continuous mining machines.

Related continuous mining machines also have a cutter drum assembly that is rotatably mounted on a forwardly extending boom member. Pluralities of cutter bits extend outwardly from the drum member. The drum member includes intermediate drum sections and a pair of end drum sections. The intermediate and end drum sections are telescopically mounted to extend the length of the drum assembly beyond the width of the machine. Extension of the end drum sections is accomplished by lateral movement of a boom member having arm members that rotatably support end drum sections. The lateral movement is generated by hydraulic piston cylinder assemblies that exert lateral pressure on the boom arms.

Another related continuous mining machine has a forwardly extending boom assembly that is pivotally secured to the frame of the mining machine. The boom assembly includes a pair of parallel forwardly extending arm members that are pivotally connected to the mining machine body portion. A pair of parallel support members is movably secured to and extends laterally from the respective arm members. A cutter drum is rotatably supported at the forward end portions of the support members. A pair of cylinder assemblies is secured to respective arm members and each includes an extensible cylinder rod secured to a support member. Actuating the cylinder assemblies extends the end drum sections laterally away from an intermediate drum section. The end drum sections are independently extendable to increase gathering efficiency.

According to related dual rotor boring machines, a lower cutter drum assembly trims material at the mine floor left uncut by the rotor arms. Typically, the cutter drum includes a center or intermediate drum section and a pair of end drum sections separated from the intermediate drum section by gear cases. The gear cases rotatably support the respective cutter drum sections.

According to one dual rotor assembly, each gear case is positioned below and centered on a rotor axis. With this arrangement, when the end drums are extended to increase the length of the lower cutter drum to increase the width of cut, gaps are formed in the cutting paths between the extended end drums and the rotor arms. This leaves uncut material or cusps projecting upwardly from the mine floor at the mine face.

A typical arrangement of these related machines includes a cutter drum section having a fixed portion and an outer extensible portion. The outer extensible portion is supported by and telescopically extends from an outboard end of the fixed portion to increase the width of cut. However, this places additional loads, e.g., bending moments, at the outboard end of the fixed portion. It is believed that the telescopic overlap of the extensible and fixed portions that is necessary to accommodate these additional loads in the extended configuration is at least 1.5 times the telescopic diameter. Moreover, the bearings and structures that support the whole cutter drum section must be made more robust to account for these additional loads.

While it is known to extend the length of a cutter drum assembly on a continuous mining machine, there is a need for an extensible cutter drum assembly on a boring type mining machine that separates the forces required for transferring torque and for extending/retracting an extension drum with respect to a main drum. In particular, there is a need for the extension drum of a lower cutter drum assembly to be supported independently of the main drum for relative extension and retraction.

BRIEF SUMMARY OF THE INVENTION

In accordance with an aspect of an embodiment of the invention, there is provided an apparatus for a mining machine that includes a mobile frame. The mobile frame has a front-end portion. A rotor assembly includes a plurality of rotor cutter arms rotatably disposed positioned forwardly of the frame front-end portion and extends the width of the frame below the rotor assembly. The cutter drum assembly includes an intermediate drum section and a pair of end drum sections. A drive shaft is rotatably mounted transversely to the frame front-end portion. The intermediate drum section and the pair of end drum sections are disposed on the drive shaft. The end drum sections are drivingly connected to the drive shaft for rotation of the end drum sections with the drive shaft. The end drum sections include an axially fixed drum portion and an extension drum portion that is axially movable on the drive shaft to extend the length of the cutter drum assembly. A hydraulic piston and cylinder arrangement is operably disposed between the drive shaft and the extension drum portion to extend and retract the extension drum portion with respect to the fixed drum portion. A torque transfer arrangement is operably disposed between the fixed and extension drum portions for mutual rotation.

In accordance with another aspect of an embodiment of the invention, there is provided a mining machine including a mobile frame that has a front end portion, a plurality of rotor assemblies that are disposed in spaced relation on the front end portion of the mobile frame, and a cutter drum assembly disposed forwardly of the front end portion. The plurality of rotor assemblies includes a plurality of rotor cutter arms. The cutter drum assembly includes an axis of rotation that is disposed transversely across the front end portion of the mobile frame, a first end drum section, a second end drum section, and an intermediate drum section that is disposed coaxially with the axis of rotation and extends between the first and second shafts. The first end drum section includes a first shaft that extends along the axis of rotation, a first end drum that is secured to the first shaft, a first end drum extension that is disposed coaxially about the axis of rotation, a first piston that is displaceable along the axis of rotation between an extended configuration of the first end drum extension and a retracted configuration of the first end drum extension, and a first coupling that transfers torque between the first end drum and the first end drum extension. The first shaft includes a first bore that extends along the axis of rotation. The first piston is relatively rotatably disposed in the first bore and is fixed with respect to the first end drum extension. The second end drum section includes a second shaft that extends along the axis of rotation and is axially spaced from the first shaft, a second end drum that is secured to the second shaft, a second end drum extension that is disposed coaxially about the axis of rotation, a second piston that is displaceable along the axis of rotation between an extended configuration of the second end drum extension and a retracted configuration of the second end drum extension, and a second coupling that transfers torque between the second end drum and the second end drum extension. The second shaft includes a second bore that extends along the axis of rotation. The second piston is relatively rotatably disposed in the second bore and is fixed with respect to the second end drum extension.

In accordance with a further aspect of an embodiment of the invention, there is provided a method of servicing a cutter drum assembly of a mining machine. The cutter drum assembly includes an axis of rotation, a first shaft that extends along the axis of rotation, a first end drum that is secured to the first shaft, a second shaft that extends along the axis of rotation and is axially spaced from the first shaft, a second end drum that is secured to the second shaft, an intermediate drum that is disposed coaxially with the axis of rotation and extends between the first and second shafts, a first drive block that rotationally couples the first shaft and the intermediate drum, a second drive block that rotationally couples the second shaft and the intermediate drum, a first support that relatively rotatably supports the first shaft and is disposed between the first end drum and the intermediate drum, a second support that relatively rotatably supports the second shaft and is disposed between the second end drum and the intermediate drum, and a rotary union that is slidingly disposed between the second support and the second shaft. The method includes disconnecting a plurality of segments of the intermediate drum, displacing each of the plurality of segments radially away from the axis of rotation, disconnecting the first drive block from the first shaft, separating the first drive block from the first shaft, disconnecting the second drive block from the second shaft, separating the second drive block from the second shaft, and extracting the rotary union from the second shaft. The plurality of segments defines an outer circumferential surface disposed around the axis of rotation. The separating the first drive block from the first shaft includes displacing the first drive block axially along the axis of rotation toward the second shaft and then displacing the first drive block radially away from the axis of rotation. The separating the second drive block from the second shaft includes displacing the second drive block axially along the axis of rotation toward the first shaft and then displacing the second drive block radially away from the axis of rotation. The extracting the rotary union from the second shaft includes displacing the rotary union along the axis of rotation toward the first shaft and then displacing the rotary union radially away from the axis of rotation.

BRIEF DESCRIPTION OF THE DRAWINGS

The accompanying drawings, which are incorporated herein and constitute part of this specification, illustrate preferred embodiments of the invention, and together with the general description given above and the detailed description given below, serve to explain features of the invention.

FIGS. 9*m* to 9*o* are photographs of the alternate lower cutter drum assembly shown in FIGS. 9*a* to 9*l*.

FIGS. 10*a* to 10*l* are schematic views of a drive gear case assembly of the lower cutter drum assembly shown in FIGS. 9*a* to 9*o*.

FIGS. 11*a* to 11*h* are schematic views of an idler shaft assembly of the lower cutter drum assembly shown in FIGS. 9*a* to 9*o*.

DETAILED DESCRIPTION OF THE PREFERRED EMBODIMENTS

Figure 1:
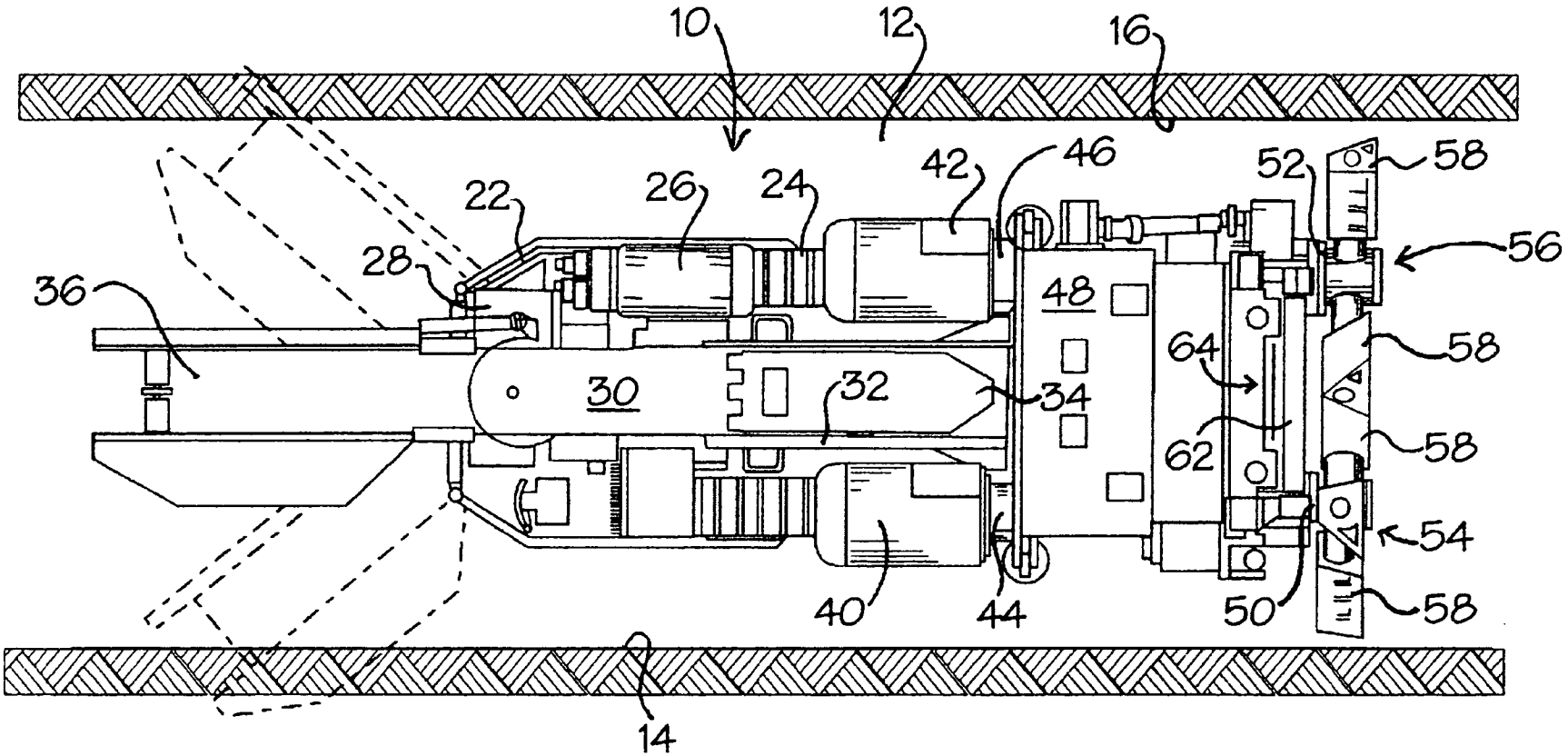
FIG. 1 is a plan view of a boring type continuous mining machine positioned in a mine entry, illustrating a pair of rotor arms for dislodging material from a mine face as the boring machine advances forwardly in the entry.
Figure 2:
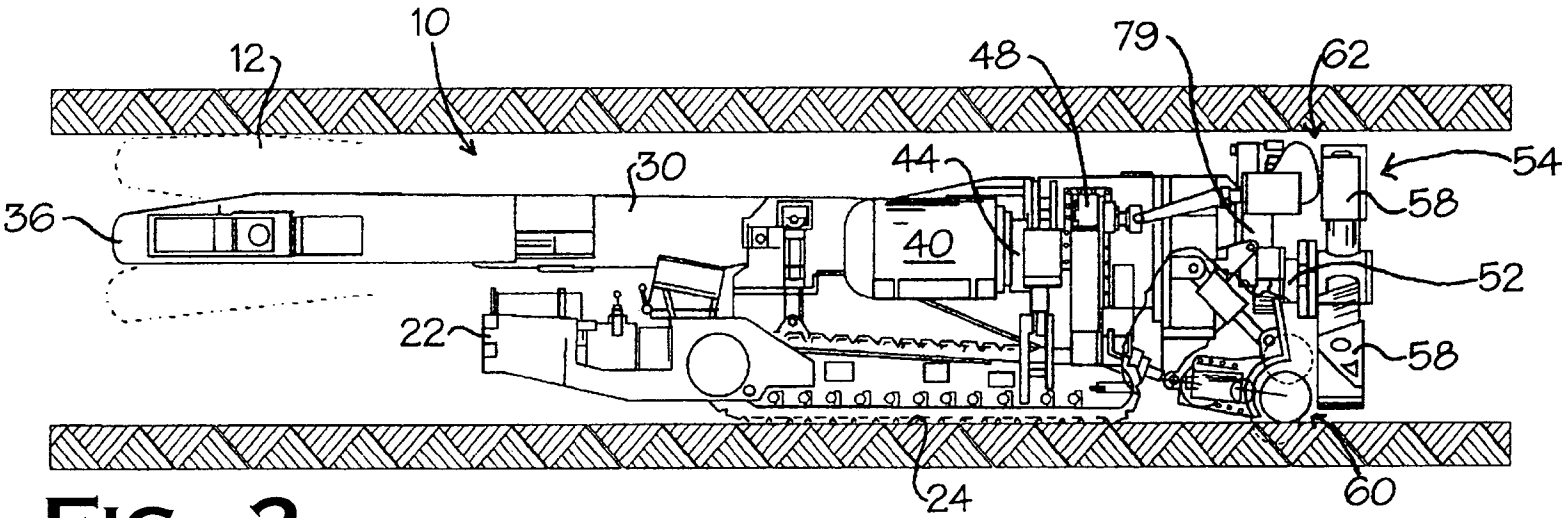
FIG. 2 is a view in side elevation of the boring machine shown in FIG. 1, illustrating one of the rotor arms and upper and lower cutter drum assemblies that dislodge material that is not removed by the rotor arms at the mine roof and floor.
Figure 3:
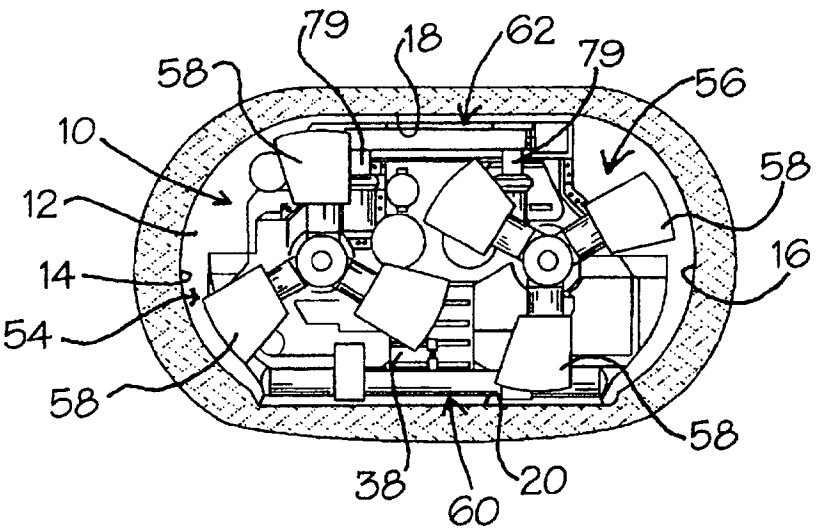
FIG. 3 is a front elevation view of the boring machine shown in FIG. 2, illustrating an oval-shaped entry cut by the combination of a pair of rotor arms and upper and lower cutter drums.

Referring initially to FIGS. 1-3, there is illustrated a boring type continuous mining machine generally designated by the numeral 10 positioned in a mine entry 12 formed by sidewalls 14 and 16, a mine roof 18, and a mine floor 20 cut by the machine 10. The mining machine 10 advances in the entry 12 to dislodge solid material from a mine face (not shown). Material is dislodged from the mine face, as the mining machine 10 advances in the entry 12 which is formed in the configuration shown in FIG. 3 having curved sidewalls 14 and 16 and a horizontal or level mine roof 18 and mine floor 20. The mine material dislodged from the mine face is gathered onto the mining machine 10 and conveyed rearwardly on the machine where it is transferred to conventional haulage equipment for transport out of the mine.

The mining machine 10 has a body portion or frame 22 suitably mounted on endless crawler tracks 24. Hydraulic motors (not shown) are mounted on the frame 22 for propelling the mining machine 10 during the mining operation. The hydraulic motors are operable through a pump 26 and a controller 28 mounted on the frame portion 22 as shown in FIG. 1. Electric motors can also be used to propel the mining machine 10.

An endless conveyor mechanism 30 is positioned in a trough 32 that extends longitudinally on the machine frame 22 from a front end 34 to an articulated rear discharge section 36. The rear discharge section 36 is laterally pivotal as shown in phantom in FIG. 1. The conveyor front end section 34 includes a pivotally mounted section 38, shown in FIG. 7, which extends forwardly of the front end of frame 22. The pivotal section 38 receives dislodged mine material which is urged by rotor arms and a lower cutter drum assembly onto the conveyor front end section 34. The dislodged material is conveyed rearwardly on the conveyor mechanism 30 to the discharge section 36 where it is transferred, for example, to a conveyor belt or shuttle car for transport out the mine.

As shown in FIG. 1, the mobile machine frame 22 supports a pair of rotor motors 40 and 42 having drive shafts 44 and 46 that extend forwardly through a main gear case 48 to shaft front-end portions 50 and 52. The shaft front-end portions 50 and 52 are positioned in spaced parallel relation on the front of the mobile frame 22. Rotors or boring heads generally designated by the numerals 54 and 56 are non-rotatably connected to the shaft end portions 50 and 52.

As seen in FIGS. 2 and 3, each rotor 54 and 56 includes a plurality of rotor arms 58. Each rotor arm 58 is telescopic in length, and a plurality of cutter bits (not shown) are mounted on each rotor arm. With this arrangement torque from the rotor motors 40 and 42 is transmitted by the drive shafts 44 and 46 to the rotors 54 and 56 which are rotated in opposite directions. The rotor arms 58 of the rotors 54 and 56 are rotated as the mining machine 10 advances forwardly to dislodge solid material from the mine face.

Figure 4:
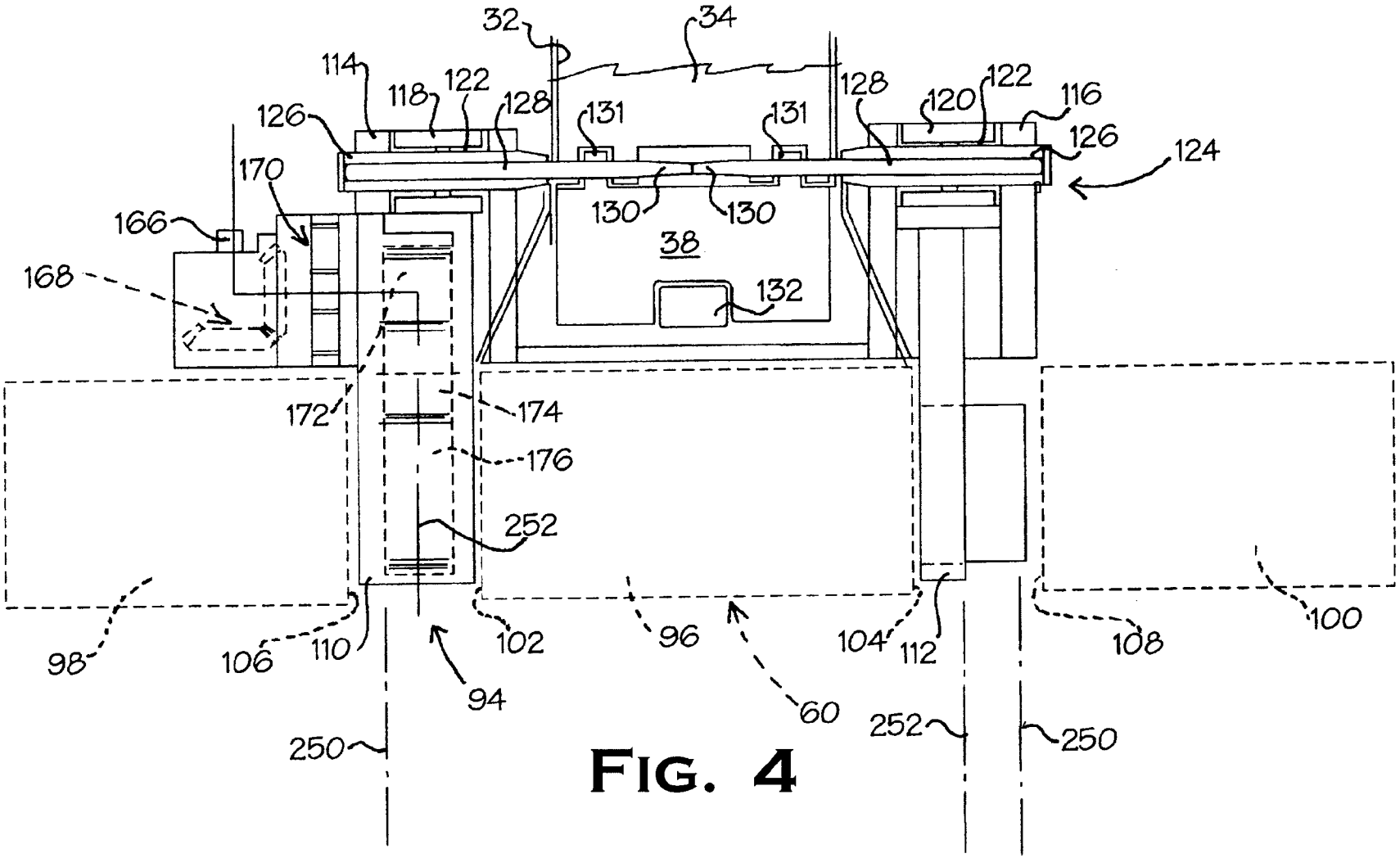
FIG. 4 is a schematic, fragmentary plan view of the lower cutter drum assembly of the boring machine shown in FIGS. 1-3 illustrating, the drum drive and pivotal mounting on the front end of the boring machine.
Figure 5:
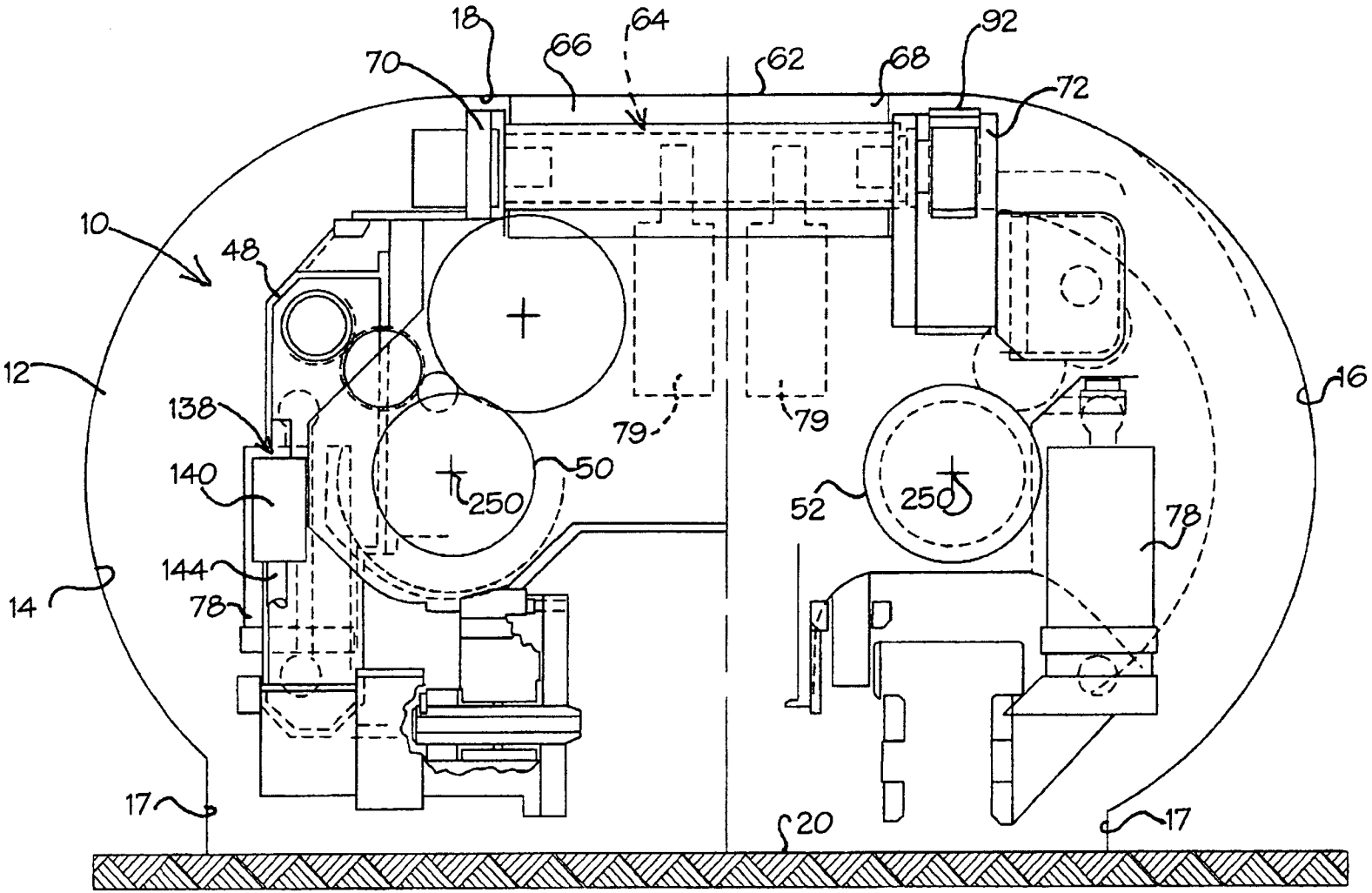
FIG. 5 is a schematic, front elevation view of the boring machine gear case and support frame for the rotor arms and upper and lower cutter drums, illustrating the frame with the rotor arms and the lower cutter drum removed.

The boring action of the rotor arms 58 forms generally semicircular sidewalls 14 and 16 in the mine face on opposite sides of the machine 10, as seen in FIGS. 3 and 5. Also formed by the boring action are cusps (not shown) upstanding from the mine floor 20 and depending from the mine roof 18. A lower cutting drum assembly and an upper cutting drum assembly, generally designated by the numerals 60 and 62 in FIGS. 2-4 and 7, dislodge these cusps. The cutter drums 60 and 62 are rotatably supported transversely on the front end of the mobile frame 22, rearwardly above and below the rotors 54 and 56.

The cutter drum assemblies 60 and 62 have a cylindrical configuration with a plurality of cutting elements that extend from the surfaces of the drums. The cutter drums 60 and 62 are operable to remove the cusps that extend from the roof 18 and floor 20 at the areas of the mine face that are beyond the cutting paths of the rotor arms 58.

In accordance with the present invention, the lower cutter drum assembly 60 is extendable in length. The assembly 60 is retracted to permit the mining machine 10 to move into and out of position opposite the mine face. Once in position opposite the mine face, the end portions of the drum assembly 60 are extended to dislodge from the mine floor at the base of the mine face, the material that is not removed by the rotor arms 58. The upper cutter drum assembly 62 is fixed in length and performs a similar function to remove cusps that extend downwardly from the mine roof.

The upper and lower cutter drums 60 and 62 are rotatably supported on the main gear case 48 of the machine frame 22. The cutter drums 60 and 62 are positioned on a front end 64 of the machine frame 22 and transverse to the longitudinal axis of the frame 22. As shown in FIG. 5, the upper cutter drum assembly 62 is a unitary structure rotatably supported at its end portions 66 and 68 by bearing assemblies 70 and 72. The bearing assemblies 70 and 72 are carried on an upper end portion of the gear case 48. In this position, the upper cutter drum 62 dislodges the material from the mine face at the mine roof 18 that is beyond the peripheral cutting paths of the rotor arms 58.

Figure 6:
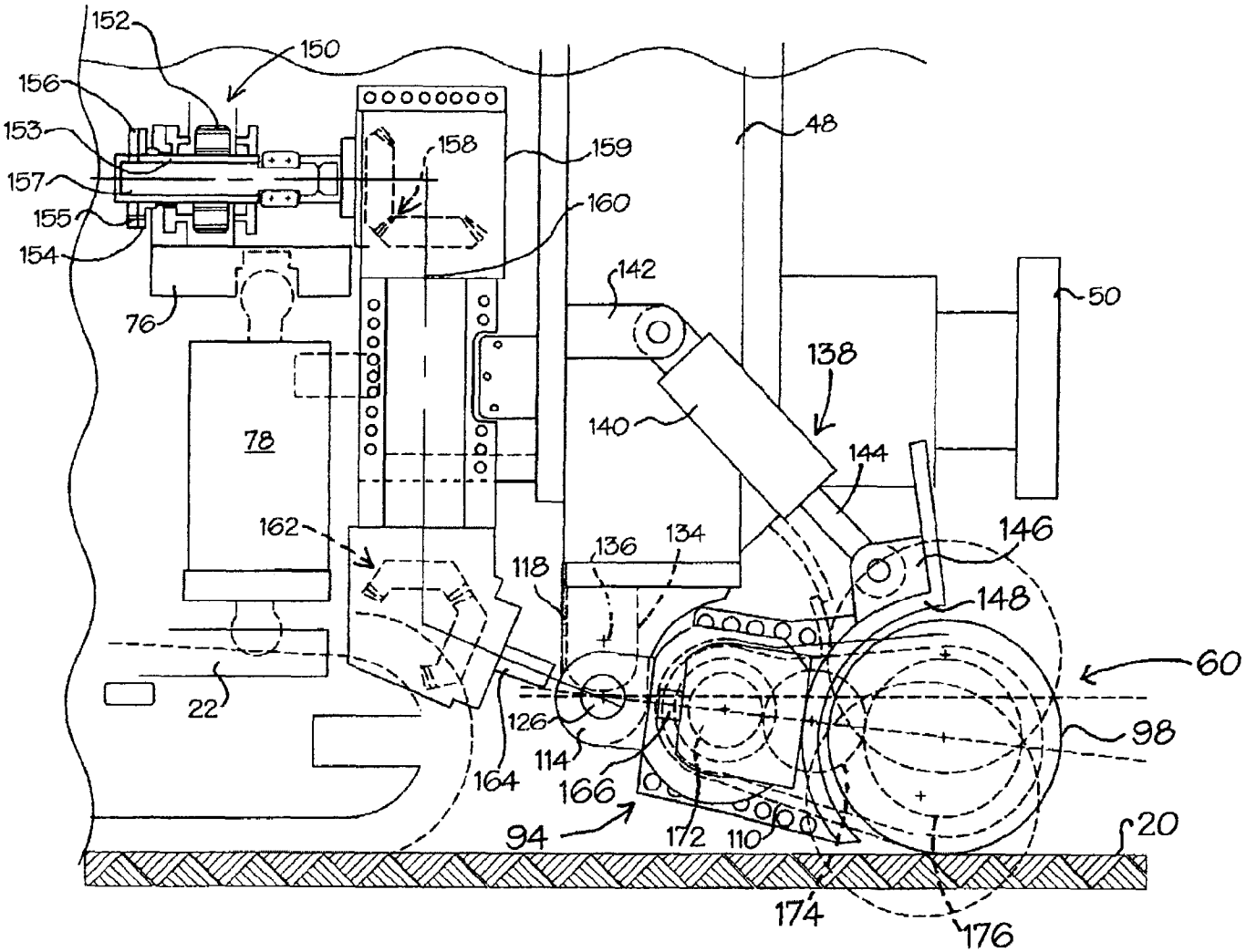
FIG. 6 is a schematic, fragmentary elevation view of the front end of the boring machine, illustrating the pivotal and drive connection of the lower cutter drum on the front end of the machine and the rotor drive shaft with the rotor arm removed for purposes of illustration.
Figure 7:
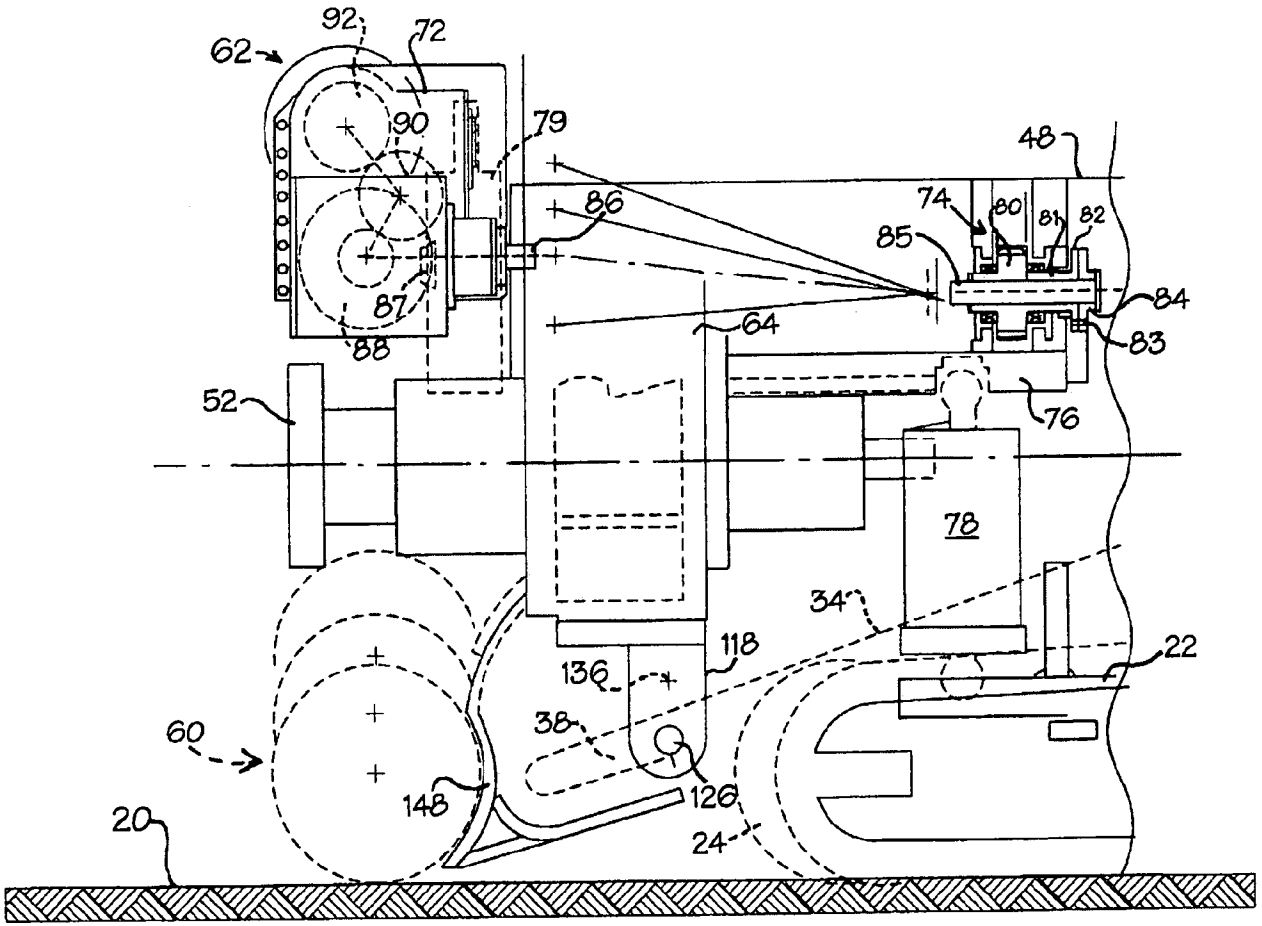
FIG. 7 is a schematic, fragmentary elevation view of the front end of the opposite side of the boring machine shown in FIG. 6, illustrating the upper and lower cutter drums and a rotor arm drive shaft.

Rotation is transmitted to the upper cutter drum 62 from the main gear case 48 through reduction gearing generally designated by the numeral 74 in FIG. 7. The reduction gearing 74 is a component of the gear case 48. A frame 76 on gear case 48 is connected to the upper end of a pair of trim cylinders 78 shown-in FIGS. 5-7. The cylinders 78 are spherically connected at their lower ends to the machine frame 22. Extension and retraction of the cylinders 78 vertically moves the front end of the gear case 48 with respect to the machine frame 22 to dislodge material as the machine 10 trams uphill or downhill.

The upper cutter drum 62 and support frame 64 are supported for vertical movement on the front end of the machine frame 22 by operation of a pair of piston cylinder assemblies 79, schematically illustrated in FIGS. 2, 3, 5 and 7. The cylinder portions of assemblies 79 are mounted on the front face of main gear case 48. The extensible rod portions are connected to the support frame 64. With this arrangement, the upper cutter drum 62 is raised and lowered relative to the main gear case 48 upon actuation of the assemblies 79.

The position of the cutter drum 62 is determined by the diameter of the bore cut by the rotors 54 and 56. In one embodiment of the mining machine 10, the rotor arms 58 of the rotors 54 and 56 are extended in length to cut bores of a diameter in the range of eight to ten feet.

As shown in FIG. 7, the reduction gearing 74 for transmitting drive to the upper cutter drum 62 includes a driven gear 80 splined to shaft 81, which is splined to a shear pin flange 82. Flange 82 is non-rotatably connected through a shear pin 83 to a driven flange 84. Flange 84 is non-rotatably connected to a shaft 85 that is rotatably journaled on gear case 48. Rotation of the gear 80 and shaft 85 is transmitted by a universal shaft (not shown), which is connected at its end portions to the shaft 85 and a shaft 86.

The shaft 86 is drivingly connected to a bevel gear 87 that meshes with a gear 88 that in turn transmits rotation through gears 90 and 92 to the upper cutter drum 62. With this arrangement, the upper cutter drum 62 is transversely positioned at a pre-selected elevation on the machine frame 22. Rotation of cutter drum 62 trims or dislodges from the mine roof 18 at the face solid material that is not dislodged by the rotor arms 58.

The lower cutter bar 60 serves a similar purpose in dislodging the solid material from the mine floor 20 at the face that is not dislodged by the rotor arms 58. As seen in FIGS. 4 and 6, the lower cutter drum assembly 60 is rotatably supported by a gear case generally designated by the numeral 94 that is pivotally mounted to the bottom of the main gear case 48. The lower cutter drum 60 includes an intermediate drum section 96 and a pair of extensible end drum sections 98 and 100. The intermediate drum section 96, as shown in FIG. 4, has outer annular edge portions 102 and 104, and the end drum sections 98 and 100 have inner annular edge portions 106 and 108, respectively. The drum sections 96, 98, and 100 include a plurality of cutting elements, shown in FIGS. 8 and 9, that extend peripherally from the drum sections.

As shown in FIG. 6, the lower cutter drum assembly 60 is supported by the gear case 94 for pivotal movement into and out of contact with the mine floor 20. The gear case 94 is pivotally connected to the lower end portion of the front end of the main gear case 48. The gear case 94 extends forwardly of the gear case 48 into the gaps between the drum intermediate section 96 and the end drum sections 98 and 100. The pivoted position of the lower cutter drum 60 in and out of contact with the mine floor is determined by the diameter bore cut by the rotors 54 and 56.

As seen in FIG. 4, the gear case 94 that rotatably supports the lower cutter drum assembly 60 includes spaced apart housing portions 110 and 112 that extend forwardly into the gaps that separate the intermediate drum section 96 from the end drum sections 98 and 100. The housings 110 and 112 extend rearwardly from the drum sections to clevis-type mountings 114 and 116 that are pivotally connected to the main gear case 48.

The mountings 114 and 116 are connected to brackets 118 and 120 that extend from the lower end portion of the gear case 48. Bushings 122 are retained in the brackets 118 and 120 and receive a pin assembly generally designated by the numeral 124. The pin assembly 124 connects the clevis-type mountings 114 and 116 to the brackets 118 and 120.

The pin assembly 124 includes a first pair of short pins 126 that are positioned in the bushings 122. The pins 126 have a through bore to receive long pins 128 having tapered end portions 130. The pins 128 extend through the gear case 48. With this arrangement, the gear case 94 including the housing portions 110 and 112 that support the lower cutter drum assembly 60 are mounted for pivotal movement about the pin assembly 124 on the machine main gear case 48.

The conveyor section 38 is also pivotally connected to the elongated pins 128, as shown in FIGS. 4 and 7. As seen in FIG. 4, the conveyor section 38 includes a pair of rearwardly extending brackets 131. The brackets 131 include through bores aligned with the bushings 122 to receive the pins 128. An idler roller 132 on the front end of the conveyor section 38 rotatably supports one end of a conveyor chain that runs through the conveyor trough 32. The conveyor chain is not shown in FIG. 4.

Preferably, the cutter drum gear case 94 is pivotally connected to the brackets 118 and 120 on the main gear case 48 as shown in FIGS. 4 and 6 for positioning the lower cutter drum assembly 60 for operation of the rotor arms 58 extended to cut bores of nine feet and ten feet in diameter. A common pivot point of the gear case 94 on the main gear case 48 is used for both the nine and ten foot cutting diameters of the rotor arms 58.

The rotor arms 58 are also operable to cut, e.g., an eight-foot diameter. To accommodate the eight-foot diameter, the gear case 94 is moved from the brackets 118 and 120. Then the brackets 118 and 120 are removed from the gear case 48 and replaced with a second set of brackets 134. The brackets 134 form a pivot point above the pivot point formed by the brackets 118 and 120. One of the brackets 134 is shown in phantom in FIG. 6. The brackets 134 are bolted to the bottom of the machine main gear case 48. Each bracket 134 includes a pivot point 136 (shown in FIG. 6) for receiving the pin assembly 124 that supports the gear case 94 for pivotal movement on the gear case 48.

Pivotal movement of the gear case 94 pivots the lower cutter drum assembly 60 relative to the main gear case 48. The pivotal movement is accomplished by the provision of a pair of cylinder assemblies generally designated by the numeral 138. Only one assembly 138 is shown in FIGS. 5 and 6, but it should be understood that an assembly 138 is positioned on each side of the machine frame 22.

Each piston cylinder assembly 138 includes a cylinder portion 140 pivotally connected at its base to a bracket 142 extending from the main gear case 48. An extensible rod 144 extends from the cylinder portion 140 and is connected at its outer end portion to a bracket 146 mounted on a pusher plate 148 that is positioned at the front-end portion of the gear case 94. The pusher plate 148 extends at its lower end portion in surrounding relation to the lower cutter drum assembly 60, as shown in FIG. 6. With this arrangement, extension and retraction of the rods 144 relative to the cylinder portions 140 pivots the gear case 94 about the main gear case 48 to raise and lower the lower cutter drum assembly 60 into and out of engagement with the mine floor 20. The relative pivoted positions of the drum assembly 60 for the cutting diameters eight, nine, and ten feet are shown in phantom in FIG. 6.

Referring to FIGS. 4-6, there is illustrated the drive connection to the lower cutter drum assembly 60 from the rotor motor 40. As shown in FIG. 6, a reduction gear assembly generally designated by the numeral 150 is mounted on the gear case 48 of machine frame portion 22. The gear reduction assembly 150 is drivingly connected in a conventional manner to the drive shaft 44 of the rotor motor 40 shown in FIG. 1.

The reduction gear assembly 150 includes a driven gear 152 splined to a shaft 153 that, in turn, is splined to shear pin flange 154. Flange 154 is non-rotatably connected through shear pin 155 to a driven flange 156. Flange 156 is non-rotatably connected to a shaft 157.

The shaft 157 is rotatably supported in the gear case 48 and drivingly connected to a bevel gear set 158 that is rotatably supported within a vertical transfer gear case 159 mounted on the machine frame main gear case 48. This arrangement is similar to the reduction gearing 74 described above for transmitting drive to the upper cutter drum 62.

From the shaft 157, rotation is transmitted through the bevel gear set 158 to a vertical shaft (not shown) rotatably supported within the transfer gear case 159. The centerline of the vertical shaft is designated by the numeral 160 in FIG. 6. Connected to the lower end of the vertical shaft in the gear case 159 is a second bevel gear set generally designated by the numeral 162. Extending from the bevel gear set 162 is a drive shaft 164 that is connected by a universal joint (not shown) to a drive shaft 166 of a bevel gear set generally designated by the numeral 168 in FIG. 4.

The bevel gear set 168 is supported by the gear case 94 and is drivingly connected through a planetary gear assembly generally designated by the numeral 170 to the drum assembly 60. Rotation from the planetary gear assembly 170 is transmitted to a pinion gear 172. From the pinion gear 172, rotation is transmitted through a reach gear 174 to a drum drive gear 176 that is rotatably supported within the gear case 94 to transmit rotation to the lower cutter drum assembly 60.

Now referring to FIGS. 8*a* to 14*l*, there is illustrated an alternate embodiment of a boring type continuous mining machine 1000. Because the overall configuration of the alternate embodiment is generally similar to that shown in FIGS. 1-7, only differences will be explained in detail.

Figure 8A:
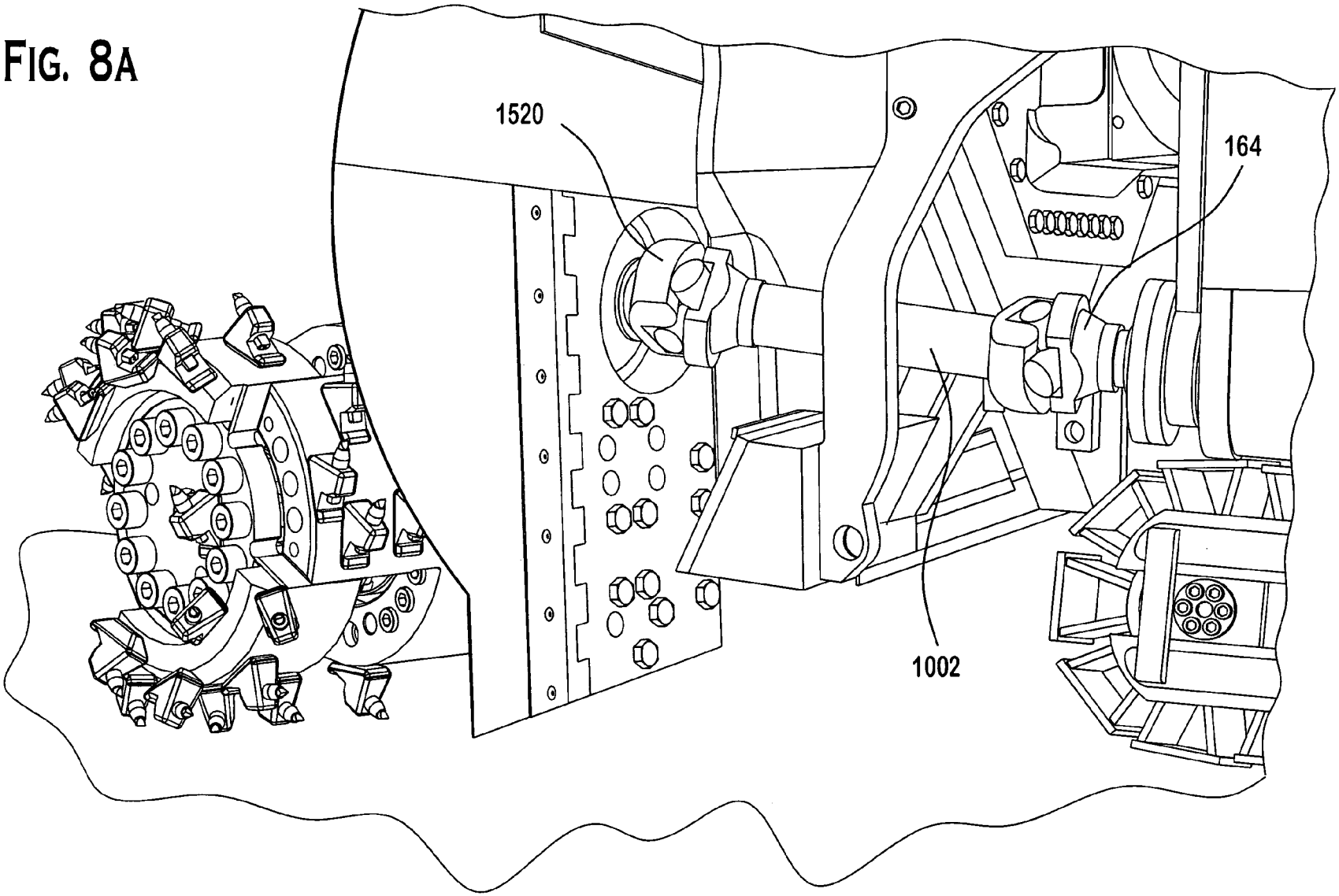
FIGS. 8*a* and 8*b* illustrate an alternate embodiment of a boring machine including a bottom bar.
Figure 8B:
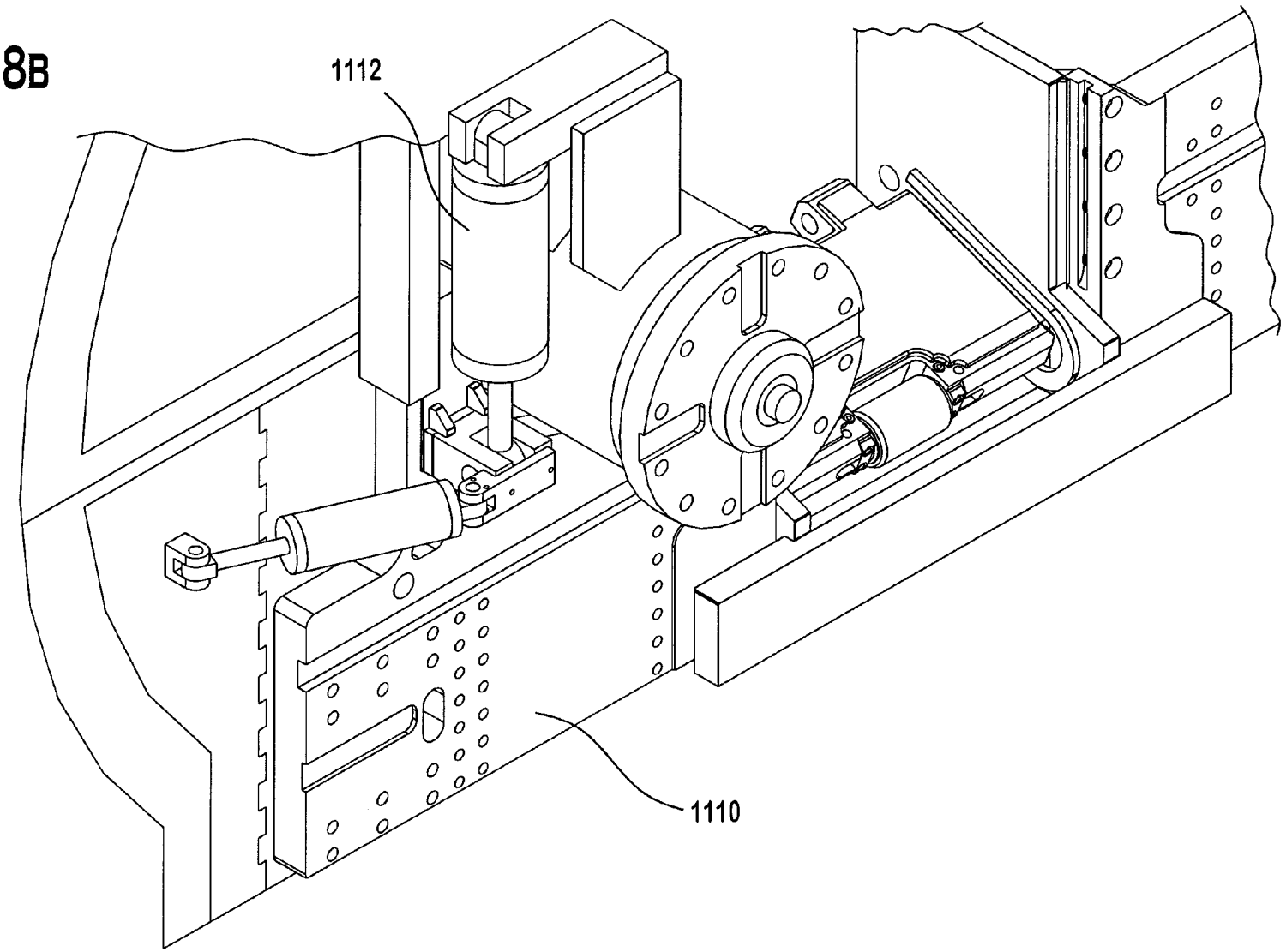

Initially referring to FIGS. 8*a* and 8*b*, there is illustrated an alternate embodiment of a boring machine including a driving connection, e.g., from the drive shaft 164 shown in FIG. 6, via a drive shaft 1002, to a lower cutter drum assembly 1100 (FIG. 8*a*). FIG. 8*b* shows a right-side portion of a bottom bar 1110 that supports the lower cutting drum assembly 1100 on the front end of the mobile frame 22.

Figure 9A:
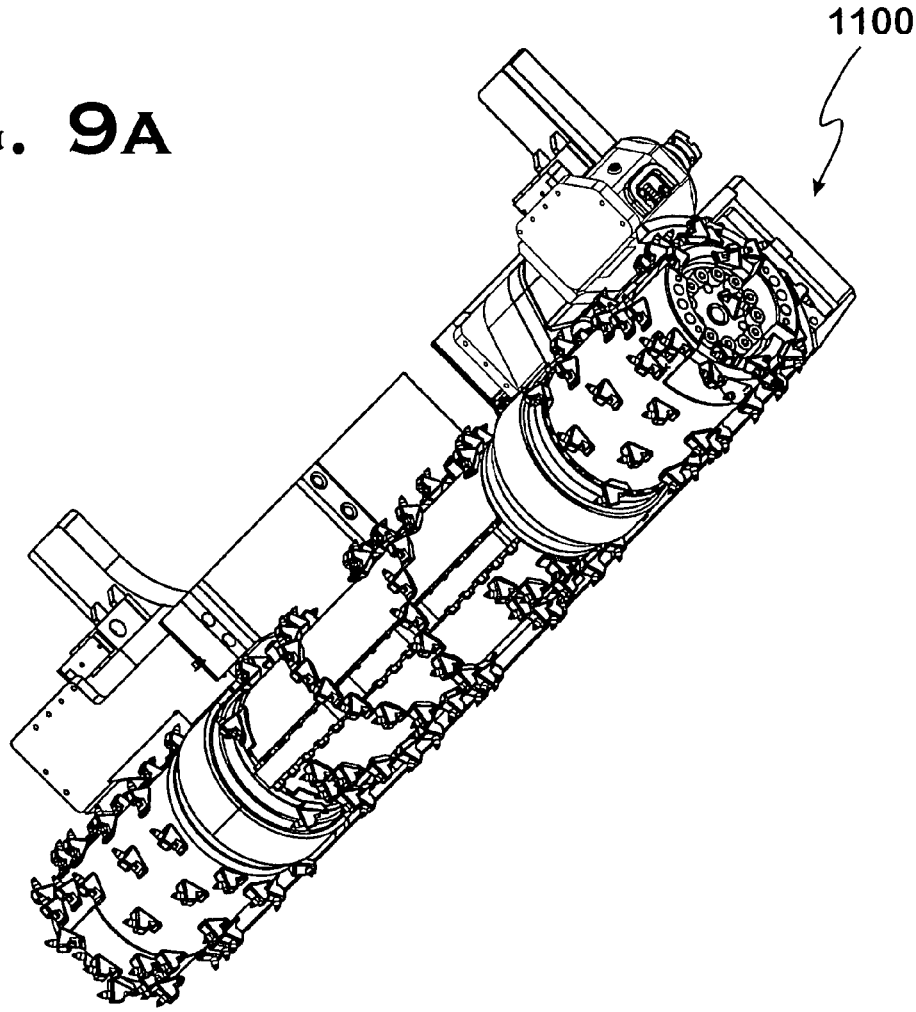
FIGS. 9*a* to 9*l* are schematic views of an alternate lower cutter drum assembly.
Figure 9B:
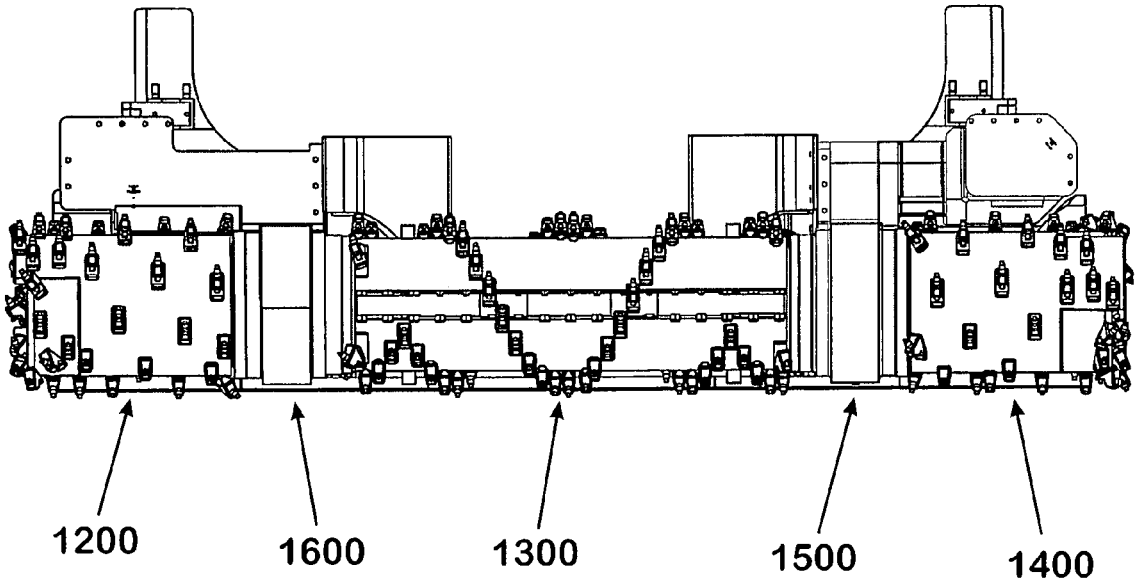
Figure 9C:
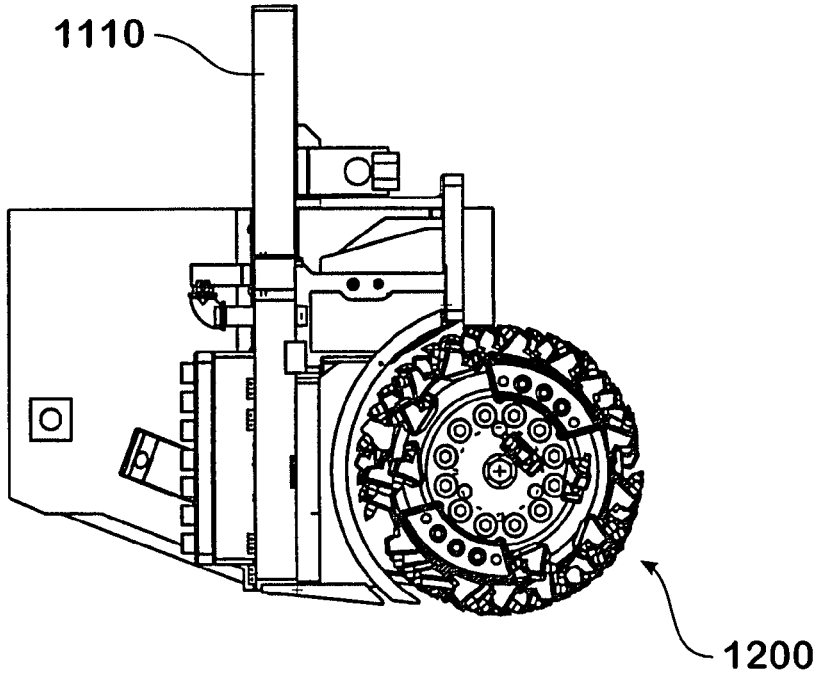
Figure 9D:
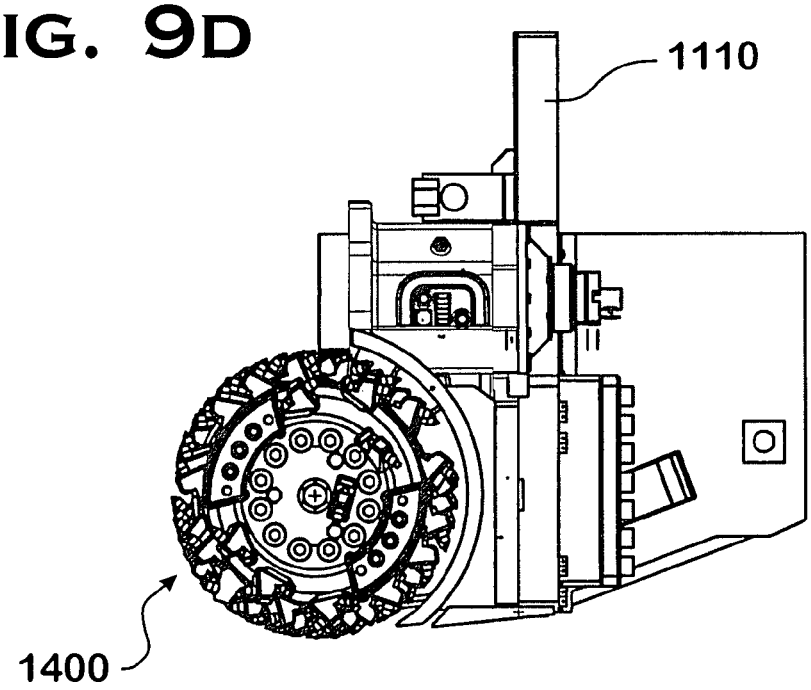
Figure 9E:
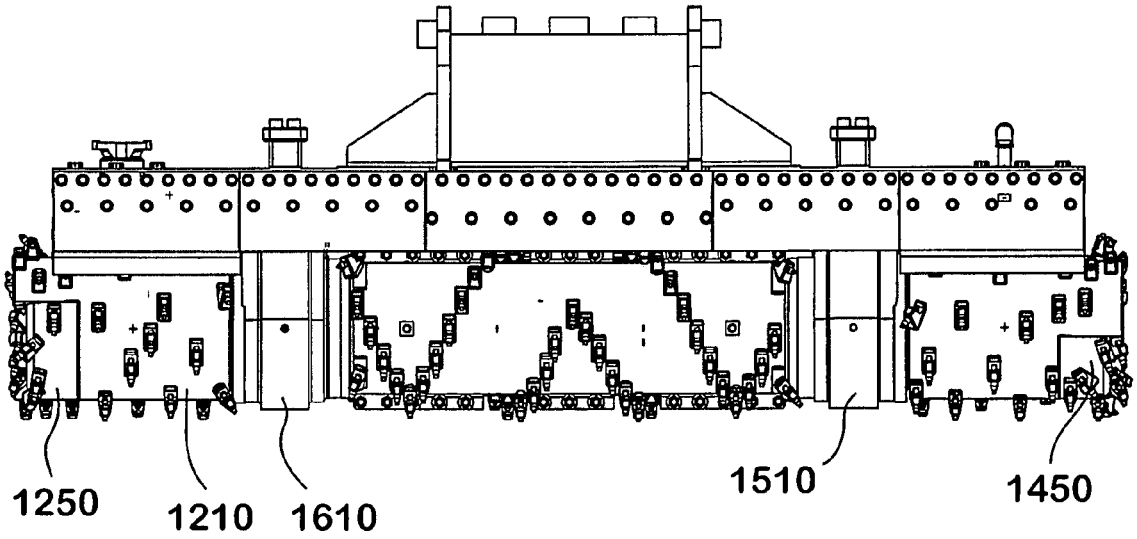
Figure 9F:
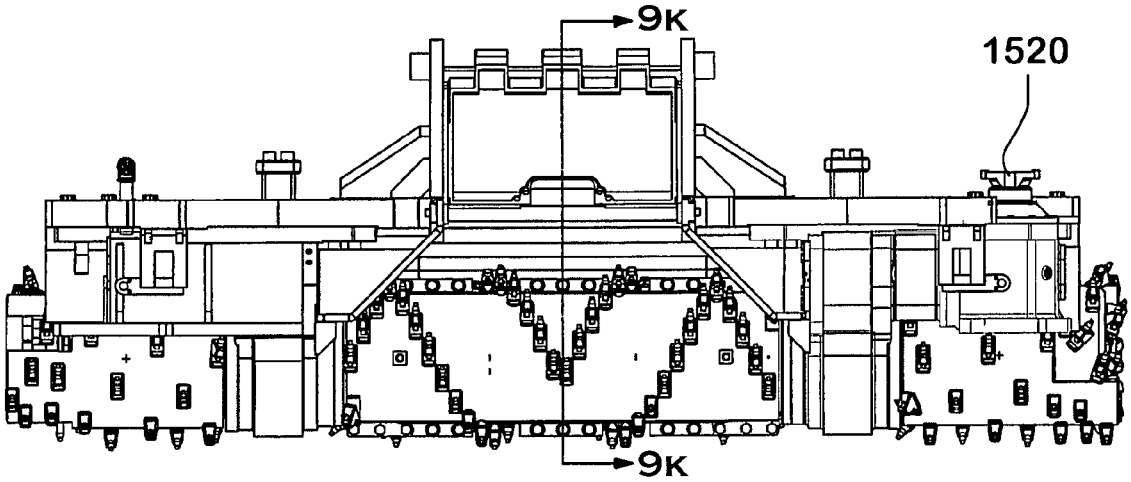
Figure 9G:
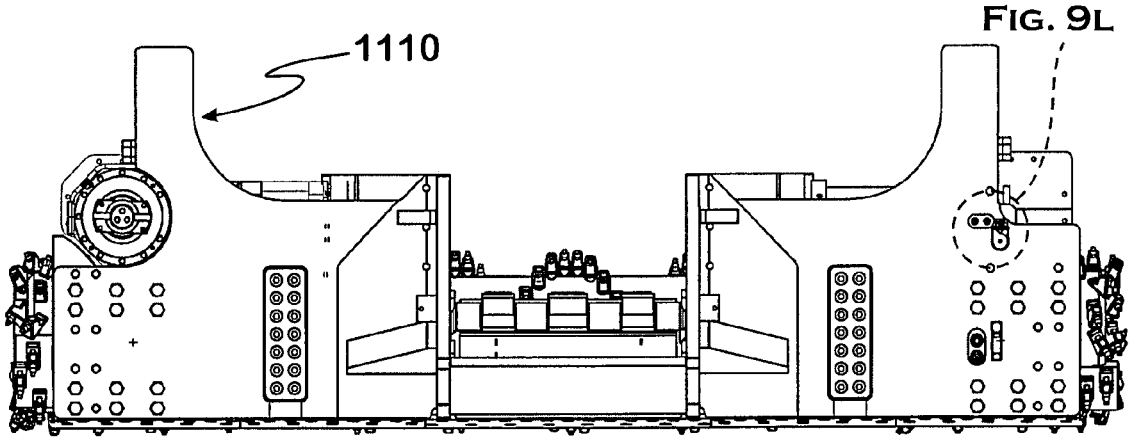
Figure 9H:
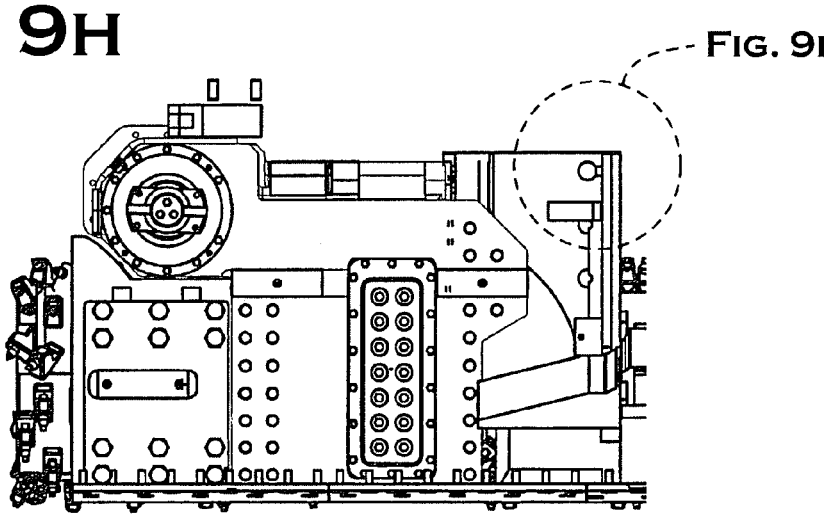
Figure 9I:
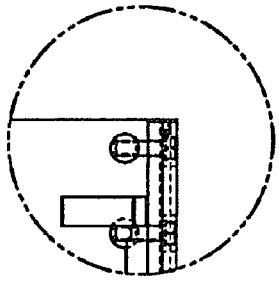
Figure 9J:
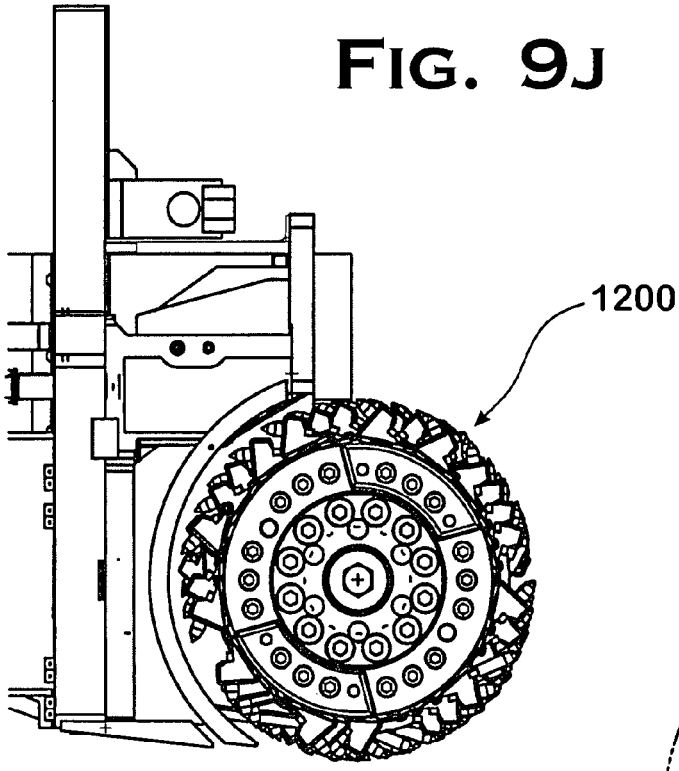
Figure 9L:
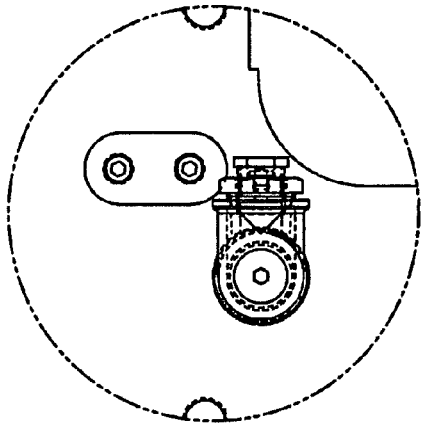
Figure 9K:
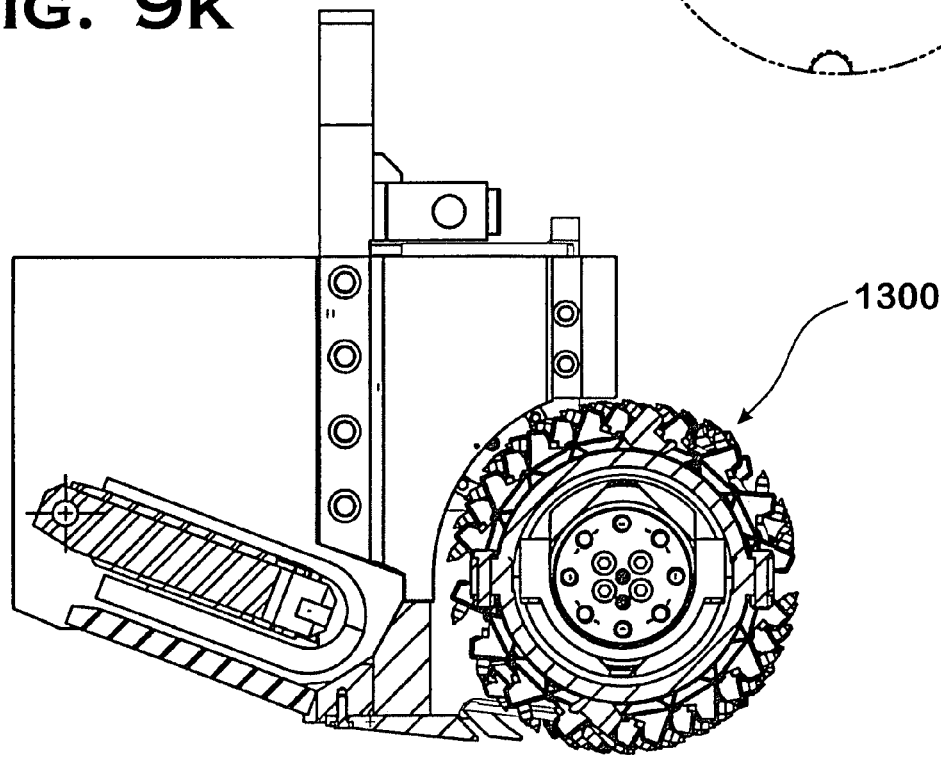
Figure 9M:
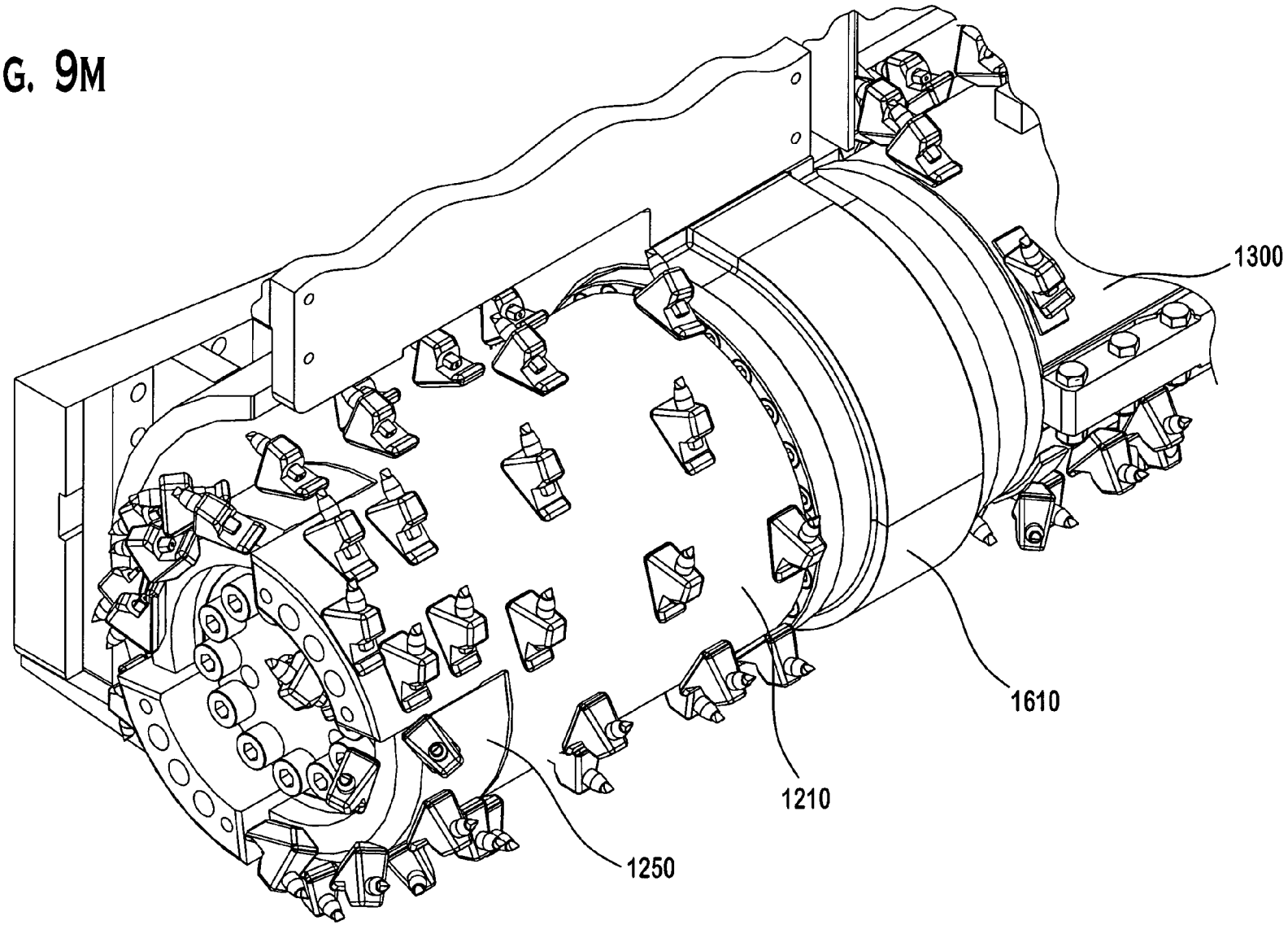

FIGS. 9*a* to 9*o* illustrate the lower cutting drum assembly 1100 including the bottom bar 1110, a right-hand end drum section 1200, a center or intermediate drum section 1300, and a left-hand end drum section 1400. The bottom bar 1110 may be adjusted vertically with respect to the mobile frame 22 by hydraulic cylinders 1112 (see FIG. 8*b*). Supporting the drum sections for rotation with respect to the mobile frame 22 are a drive assembly 1500 and an idler assembly 1600. The drive assembly 1500 is preferably disposed between the left-hand end drum section 1400 and the intermediate drum section 1300, and the idler assembly 1600 is preferably disposed between the right-hand end drum section 1200 and the intermediate drum section 1300. It is also envisioned that the positions of the drive assembly 1500 and the idler assembly 1600 may be reversed. A right-hand end drum extension 1250 is disposed at the outboard end of the right-hand end drum section 1200, and a left-hand end drum extension 1450 is disposed at the outboard end of the left-hand end drum section 1400.

Pluralities of cutting elements e.g., bits, picks, etc., are secured to and extend outwardly from the peripheral surfaces of each of the drum sections 1200, 1300, 1400 and of the drum extensions 1250, 1450. As is well understood, the cutting elements may be exchangeable. Rotation of the drum sections 1200, 1300, 1400 and the drum extensions 1250, 1450 dislodges the cusps of solid material on the mine floor 20 that are left uncut by the rotors 54, 56. The lower cutting drum assembly 1100 cuts the mine floor 20 adjacent to the mine face, thereby forming a generally horizontal surface on the mine floor 20 and forming the vertical portions 17 of the sidewalls 14, 16, as shown in FIG. 5.

Figure 9N:
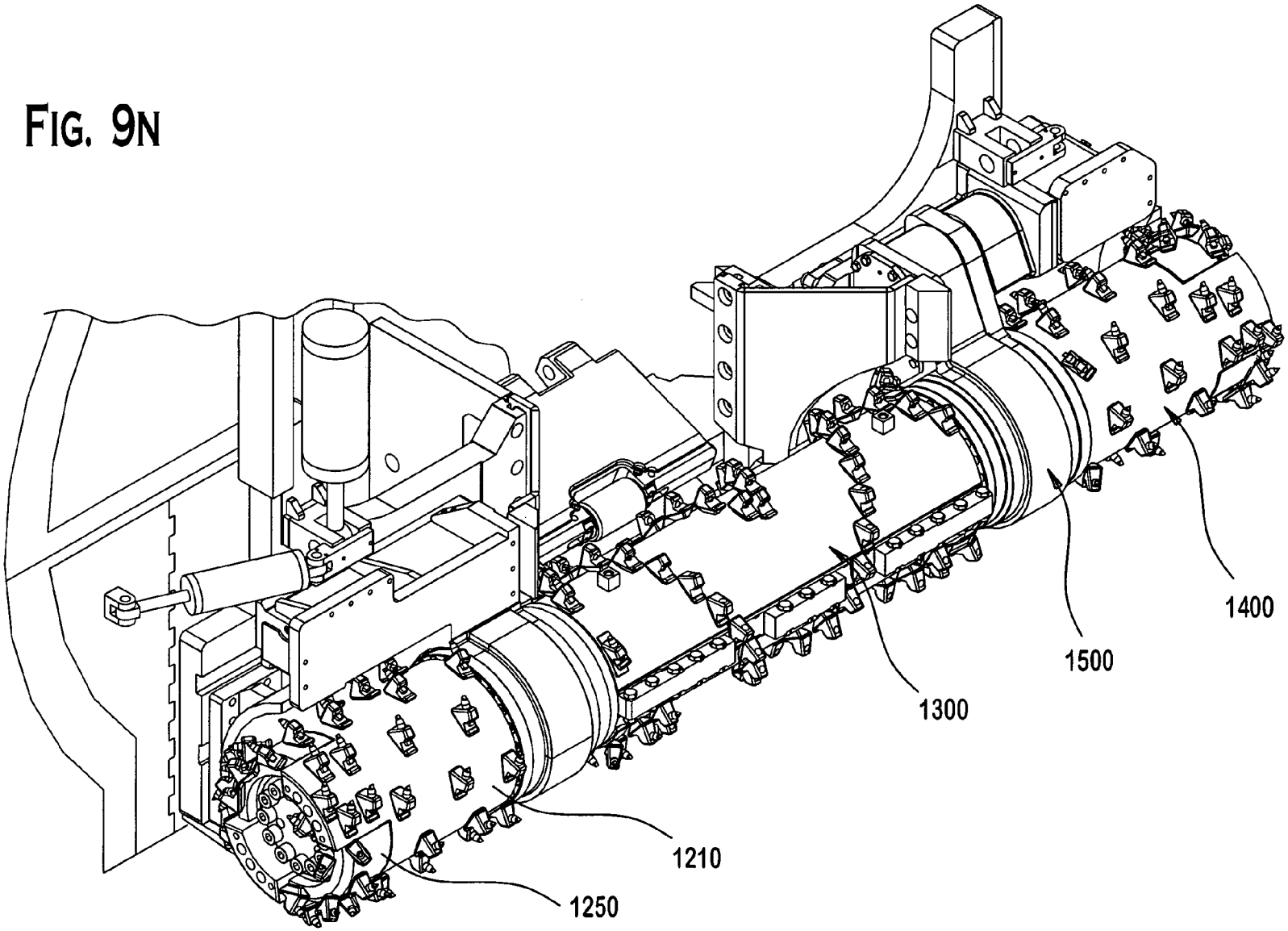
Figure 90:
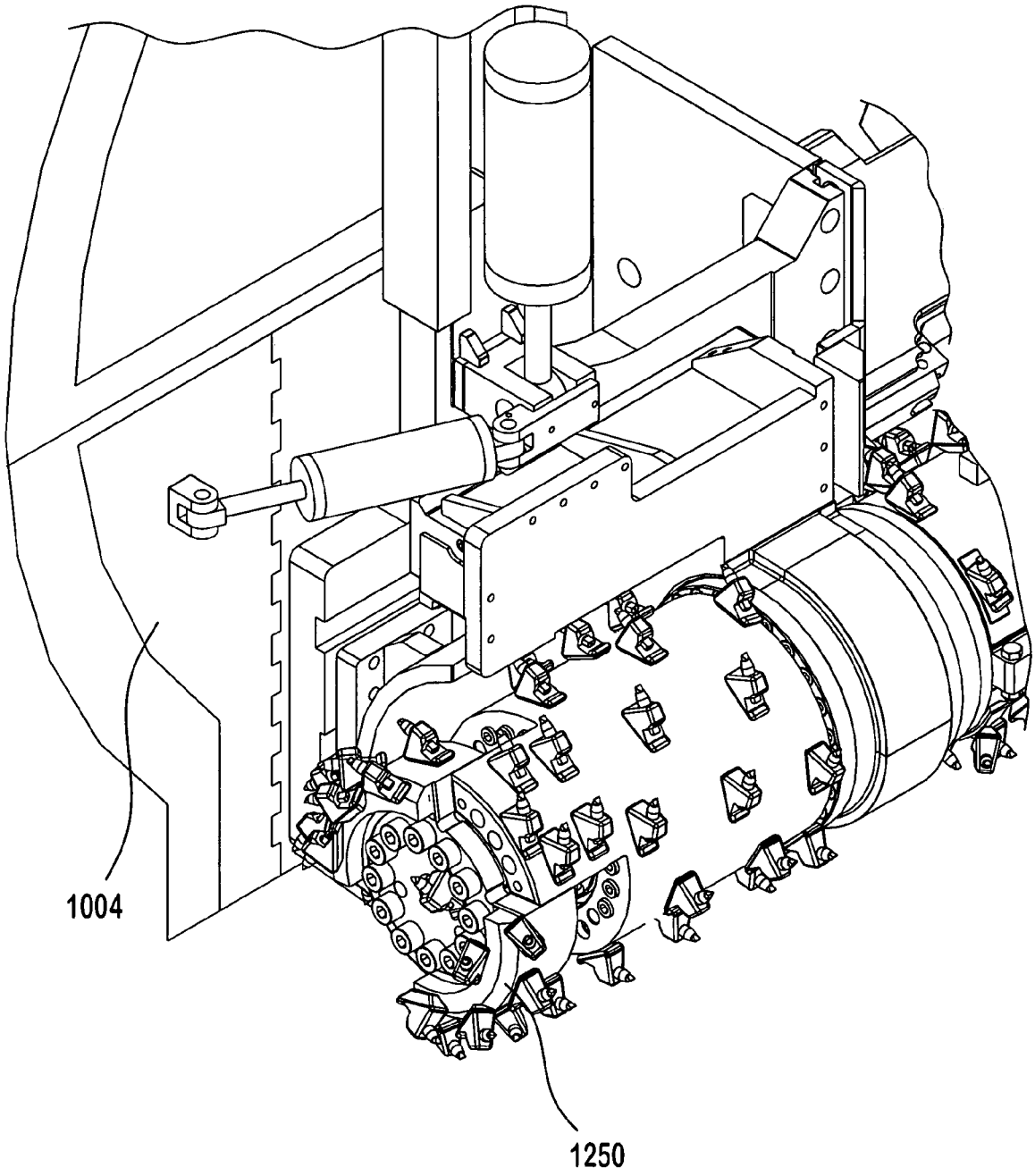
Figure 101:
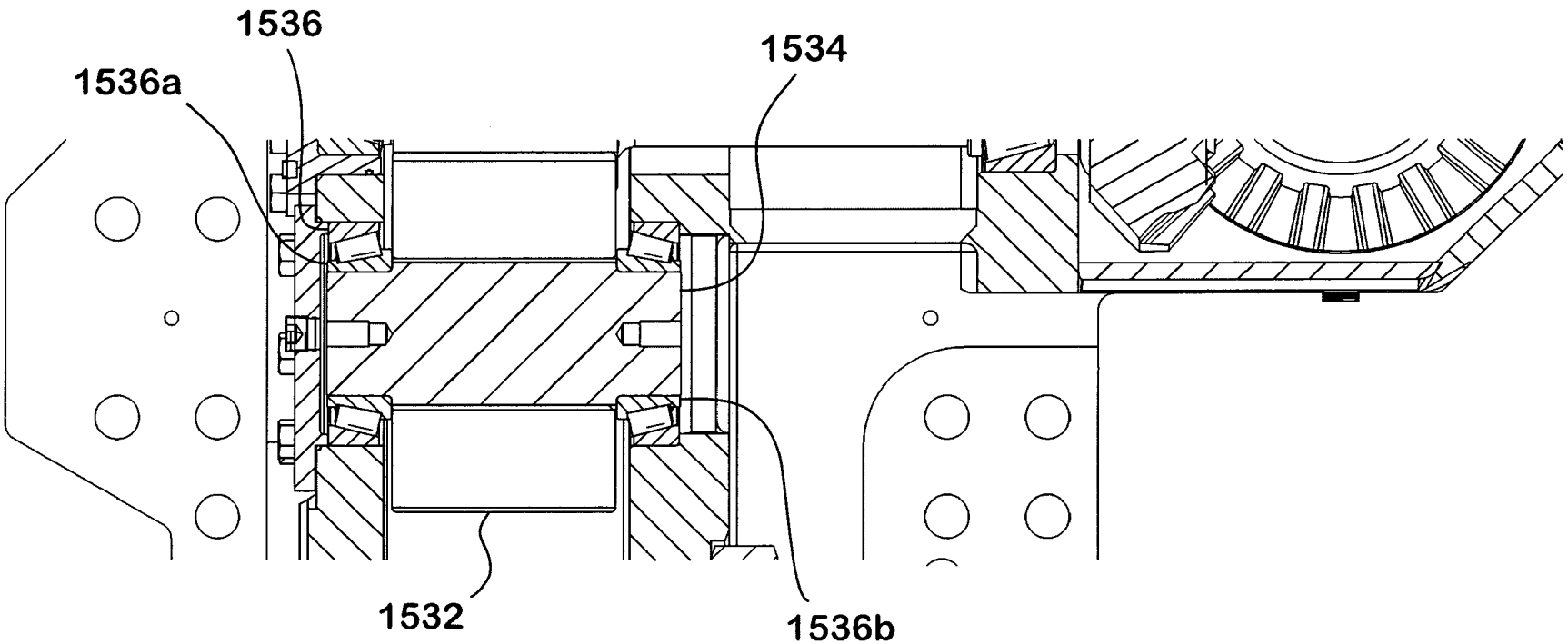

The drum extensions 1250, 1450 may be disposed axially between a contracted configuration, e.g., shown in FIGS. 9*a* to 9*n*, and an extended configuration, e.g., shown in FIG. 9*o*, with respect to the drum sections 1200, 1400, respectively. Also shown in FIG. 9*o* is a hinged door 1004 with respect to the mining machine 1000. By hydraulically opening and closing the door 1004, i.e., spacing the door 1004 from and toward the mining machine 1000, it is possible to adjust a protective shield to correspond to the length of the lower cutter drum assembly 1100, and thereby match the shape of the sidewalls 14, 16.

Referring now to FIGS. 10*a* to 10*m*, the drive assembly 1500 includes a housing 1510 that is supported on the left-side portion of the bottom bar 1110. Torque for driving the lower cutting drum assembly 1100 is transferred via, e.g., the drive shaft 1002 shown in FIG. 8*a*, to a yoke 1520. Referring particularly to FIGS. 10*g* to 10*j*, the yoke 1520 is coupled for rotation with an input shaft 1522, which is supported in the housing 1510 by bearings 1524*a*, 1524*b*. A right-angle gear set 1526 preferably includes a first bevel gear 1526*a*, which is coupled for rotation with the input shaft 1522, and a second bevel gear 1526*b*, which is coupled for rotation with a pinion shaft 1528. The pinion shaft 1528 is supported by bearings 1530*a*, 1530*b* for relative rotation with respect to the housing 1510. Preferably, the pinion shaft 1528 includes a pinion 1528*a* that drivingly engages a reach gear 1532 fixed on a reach shaft 1534 that is also supported in the housing 1510, e.g., by bearings 1536*a*, 1536*b*. In turn, the reach gear 1532 drivingly engages an output gear 1538 that is fixed on an output shaft 1540, which is also supported in the housing 1510, e.g., by bearings 1541*a*, 1541*b*. Accordingly, the yoke 1520, the input shaft 1522, the right-angle gear set 1526, the pinion shaft 1528, the reach gear 1532, and the output gear 1538 transfer driving torque, such as from the drive shaft 1002, to the output shaft 1540. Moreover, this system of gears and shafts is supported for rotation relative to the housing 1510 by bearings, which are preferably anti-friction bearings.

Figure 10C:
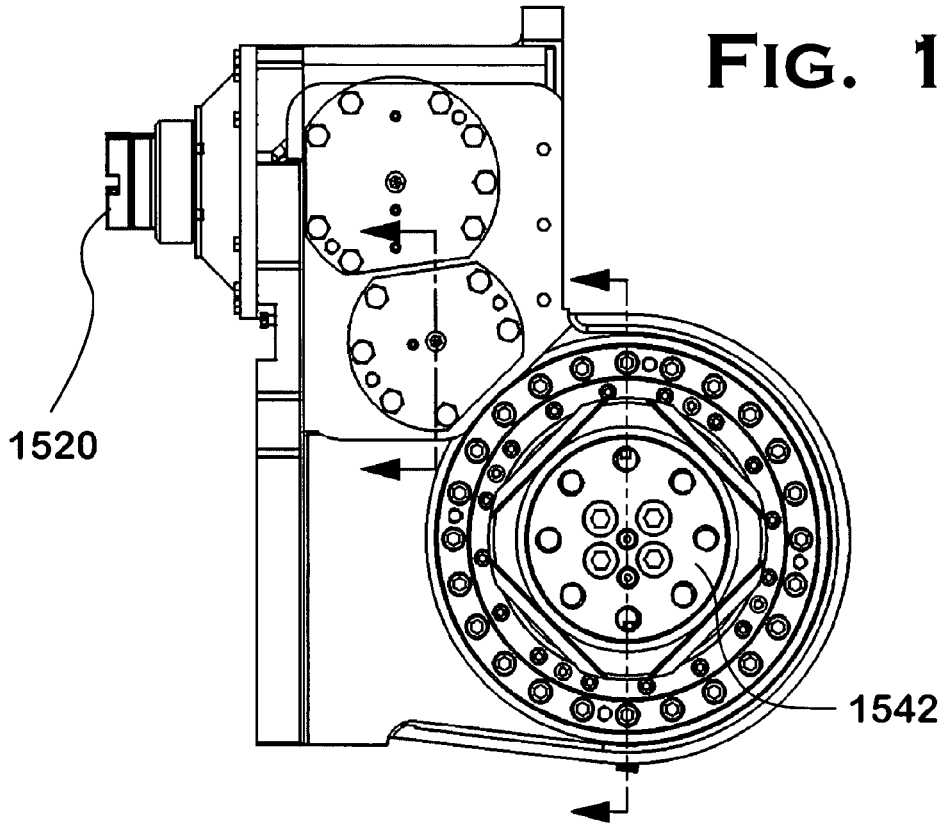
Figure 10D:
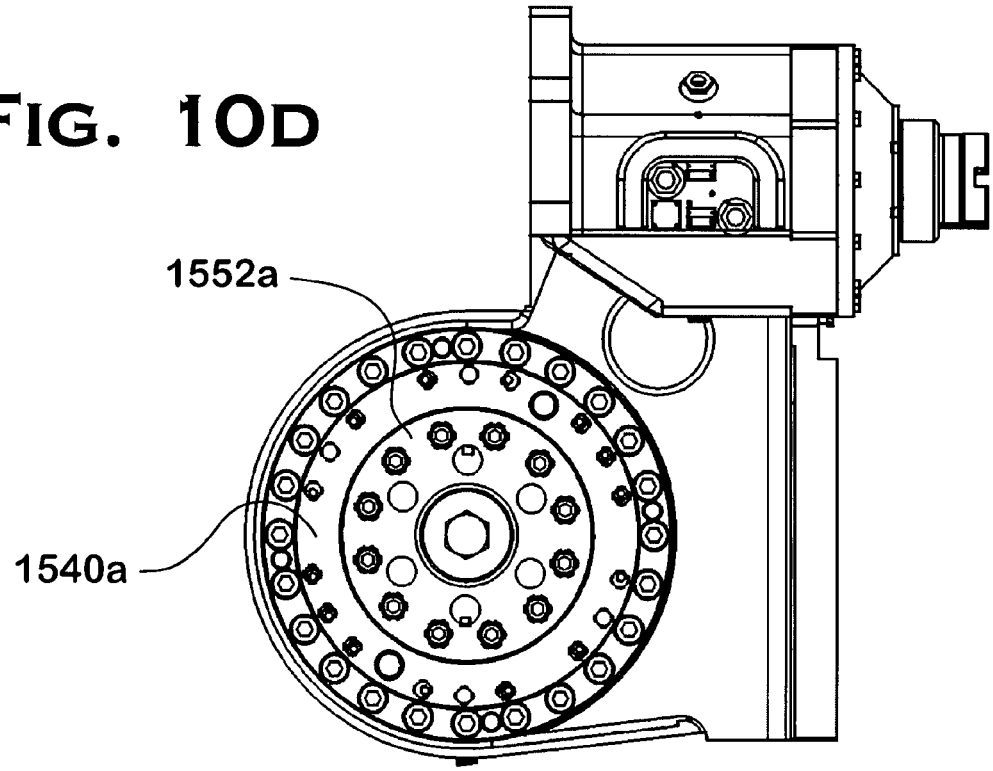
Figure 10G:
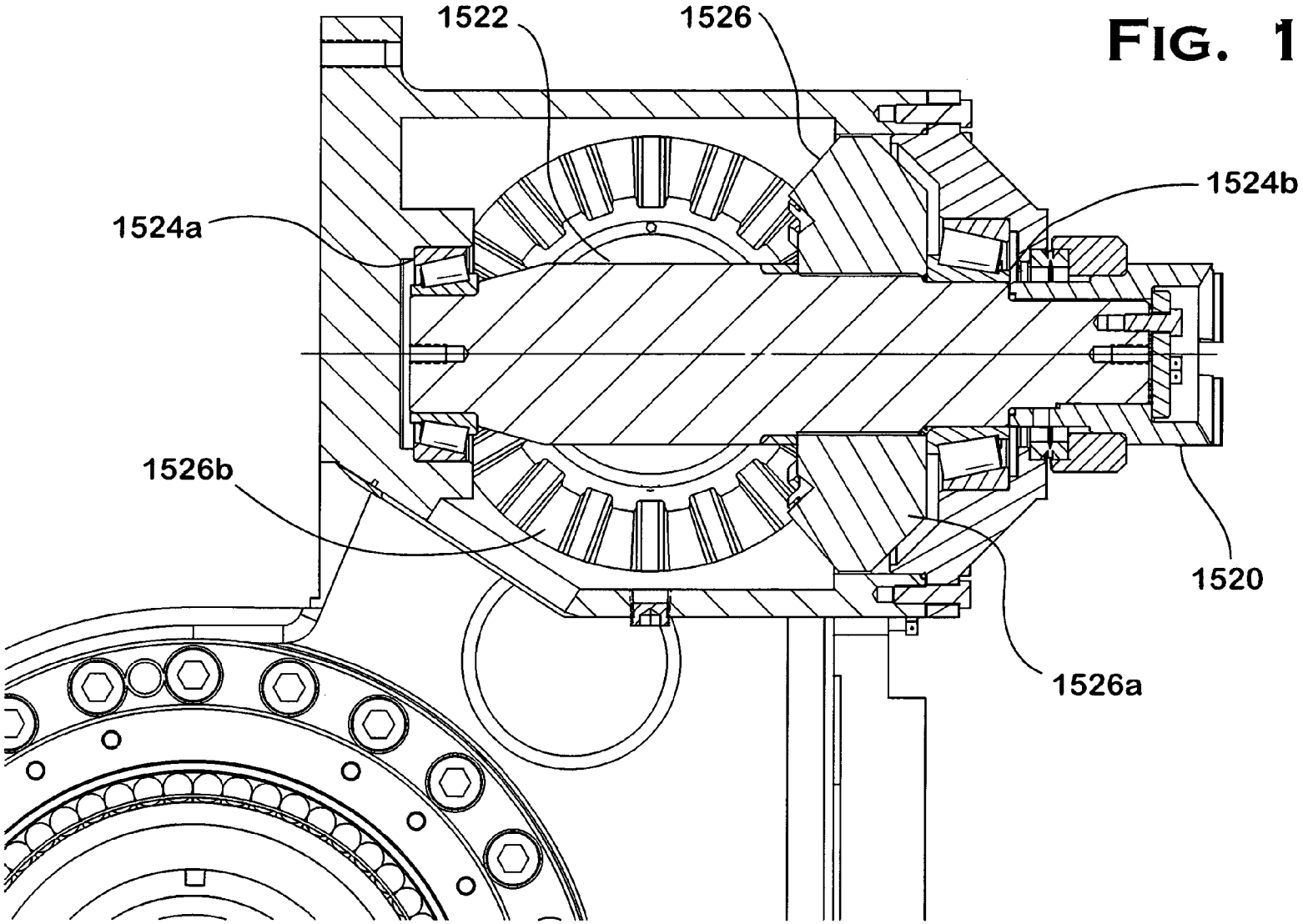
Figure 10H:
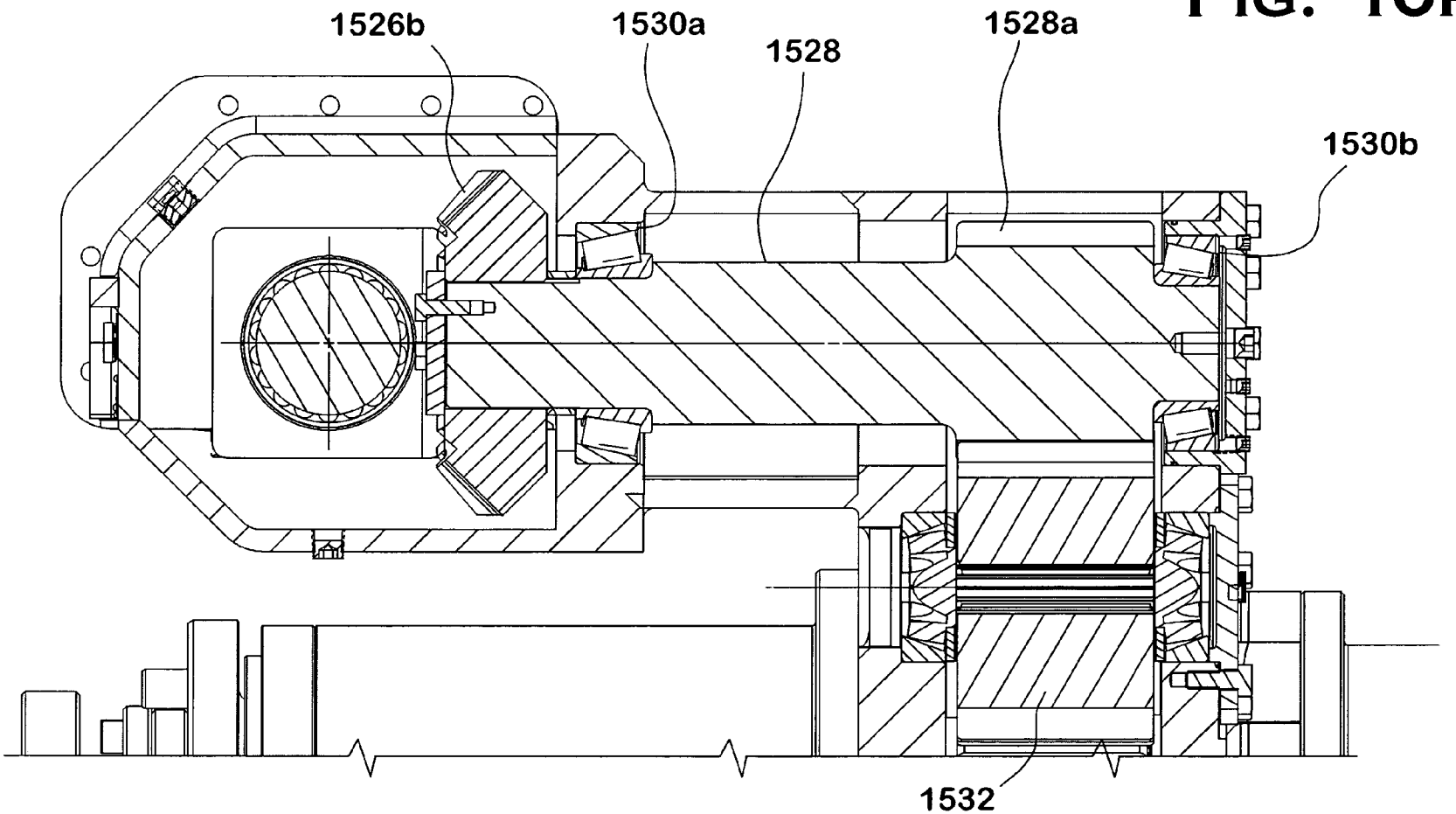
Figures 10J, 10K:
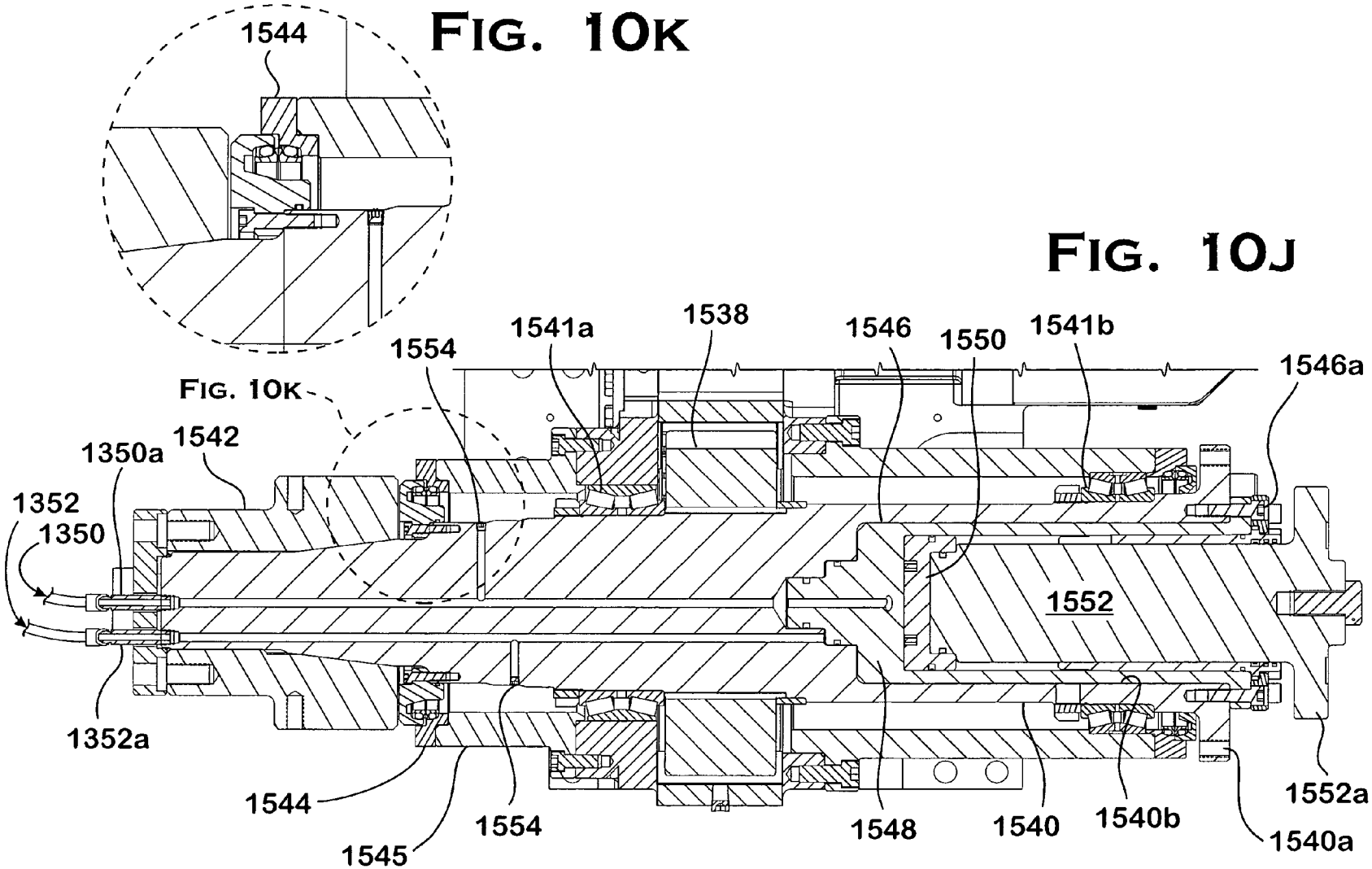
Figure 10M:
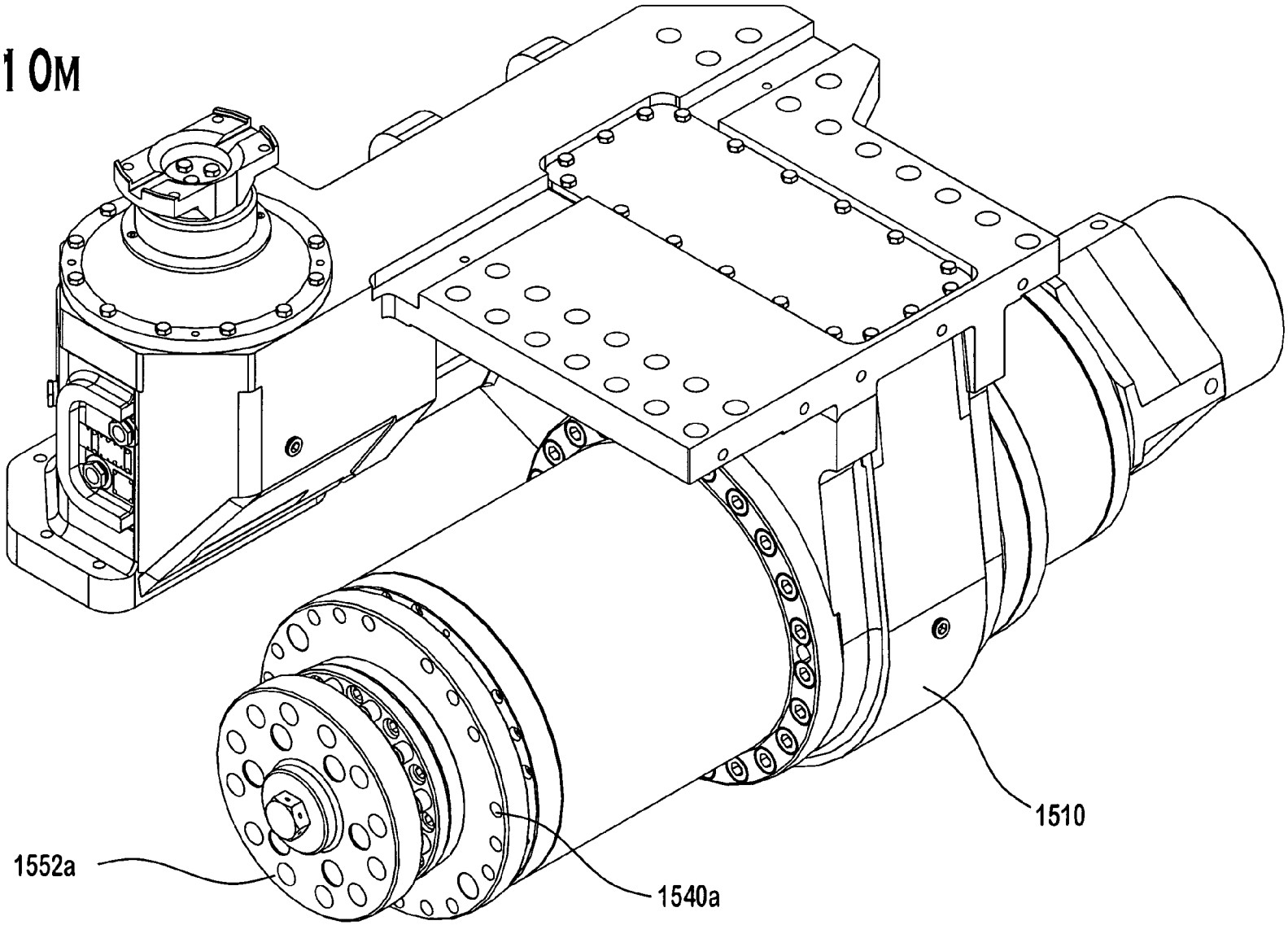
FIG. 10*m* is a photograph of the drive gear case assembly shown in FIGS. 10*a* to 10*l*.

The three primary functions of the output shaft 1540 will now be explained with particular reference to FIG. 10*j*. First, the output shaft 1540 drivingly supports a left-hand end drum 1410 of the left-hand end drum section 1400. Second, the output shaft 1540 supplies driving torque to the intermediate and right-hand end drum sections 1300, 1200. And third, the output shaft 1540 extensibly supports the left-hand end drum extension 1450 of the left-hand end drum section 1400.

Preferably, the output shaft 1540 is formed with a fixture 1540*a*, e.g., a mounting flange, to which the left-hand end drum 1410 is secured, e.g., by bolts or other fasteners. The fixture 1540*a* is shown in FIG. 10*j* proximate an outboard end of the output shaft 1540, but may be disposed at any suitable position along the output shaft 1540. Accordingly, the driving torque provided to the output shaft 1540 via the output gear 1538 is transferred to the left-hand end drum 1410.

Preferably disposed at an inboard end of the output shaft 1540 is a drive block 1542. The drive block 1542 is secured to the output shaft 1540 and provides a mating surface for transferring driving torque to the intermediate drum sections 1300. Preferably, a seal system 1544 is axially disposed between the between the drive block 1542 and a tubular extension 1545 that is coupled to the housing 1510. The seal system 1544, which may include a mechanical face seal, is preferably coupled directly to the output shaft 1540, i.e., as opposed to be coupled to the drive block 1542. If the drive block 1542 is unsecured and separated from the output shaft 1540, access may be gained to inspect, service, or replace the seal system 1544.

The third primary function of the output shaft 1540, i.e., supporting the left-hand end drum extension 1450 for axial displacement between its extended and retracted configurations, is separately provided with respect to transferring driving torque to the left-hand end drum 1410. An axial bore 1540*b* in an outboard end of the output shaft 1540 receives a hydraulic cylinder 1546. Preferably, the hydraulic cylinder 1546 is secured to the output shaft 1540 by bolts or other fasteners 1546*a*, and thus the entire hydraulic cylinder 1546 may be replaced as a unit by removing the bolts 1546*a*. As is well understood, the hydraulic cylinder 1546 includes a cylinder body 1548 and a piston 1550, which per se is relatively rotatably disposed in the cylinder body 1548. The piston 1550 is preferably coupled by a piston rod 1552, which per se is also relatively rotatably disposed in the cylinder body 1548, to the left-hand end drum extension 1450. As shown in FIG 10*j*, a fixture 1552*a*, e.g., a mounting flange, at an outboard end of the piston rod 1552 may be used to secure, e.g., by bolts or other fasteners, the left-hand end drum extension 1450 to the piston rod 1552. The hydraulic fluid required to displace the piston 1550 in the cylinder body 1548, and thereby extend or retract the left-hand end drum extension 1450, may be supplied to the cylinder body 1548 via conduits 1554 that extend through the output shaft 1540.

Referring now to FIGS. 11*a* to 11*h*, the idler assembly 1600 includes a housing 1610 that is supported on the right-side portion of the bottom bar 1110. As compared to the housing 1510 of the drive assembly 1500, the housing 1610 does not include a drive train. However, referring particularly to FIG. 11*d*, an idler shaft 1640 similar to output shaft 1540 is supported in the housing 1610, e.g., by bearings 1612*a*, 1612*b*. Preferably, the idler and output shafts 1640, 1540 per se are interchangeable.

Figure 11A:
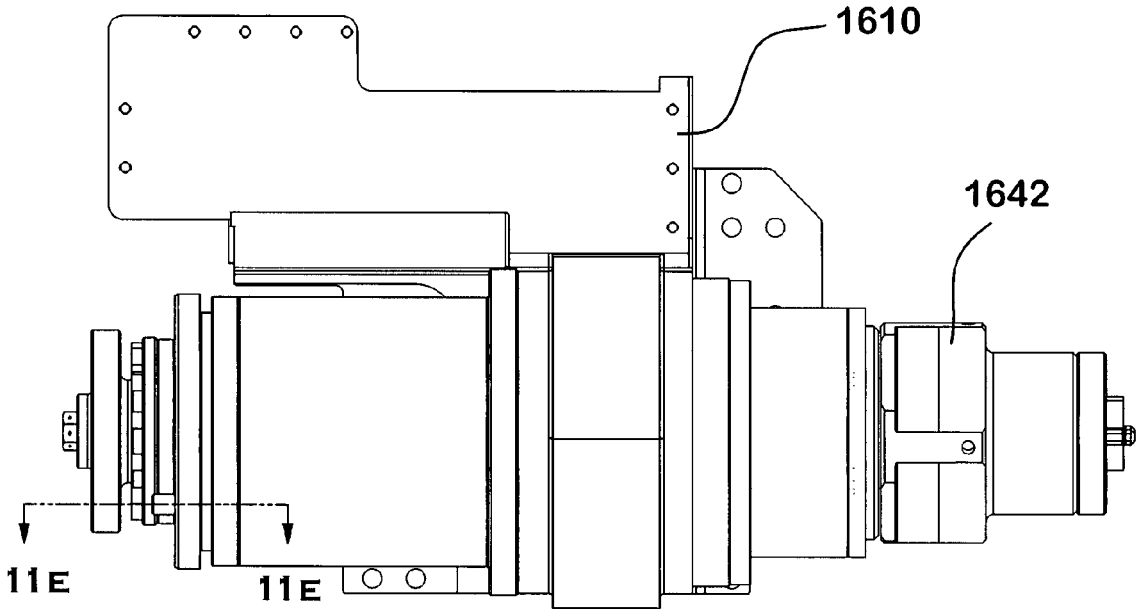
Figure 11B:
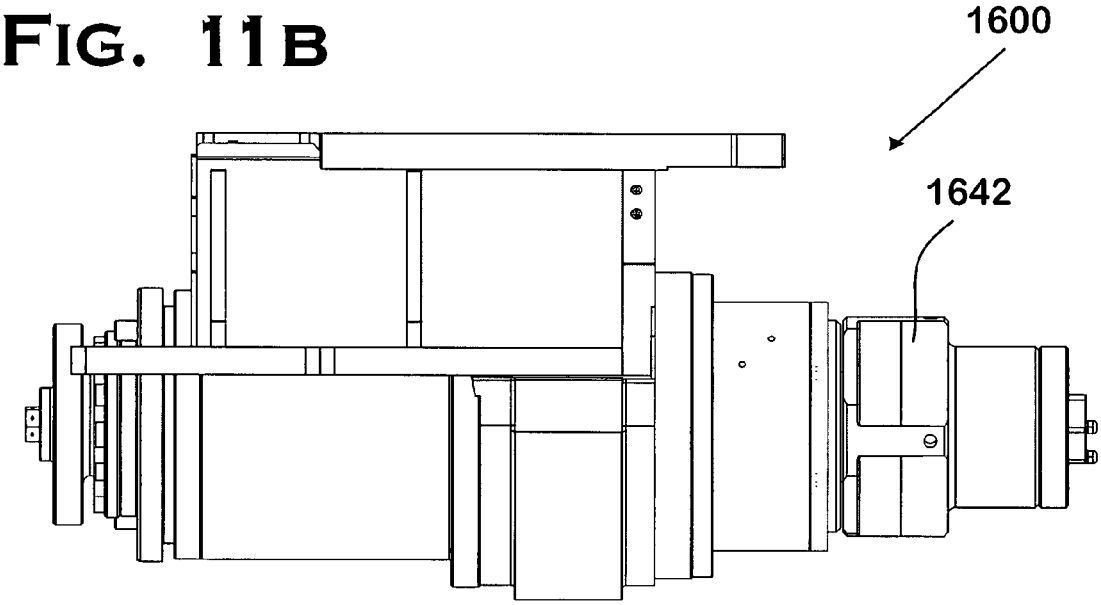
Figure 11C:
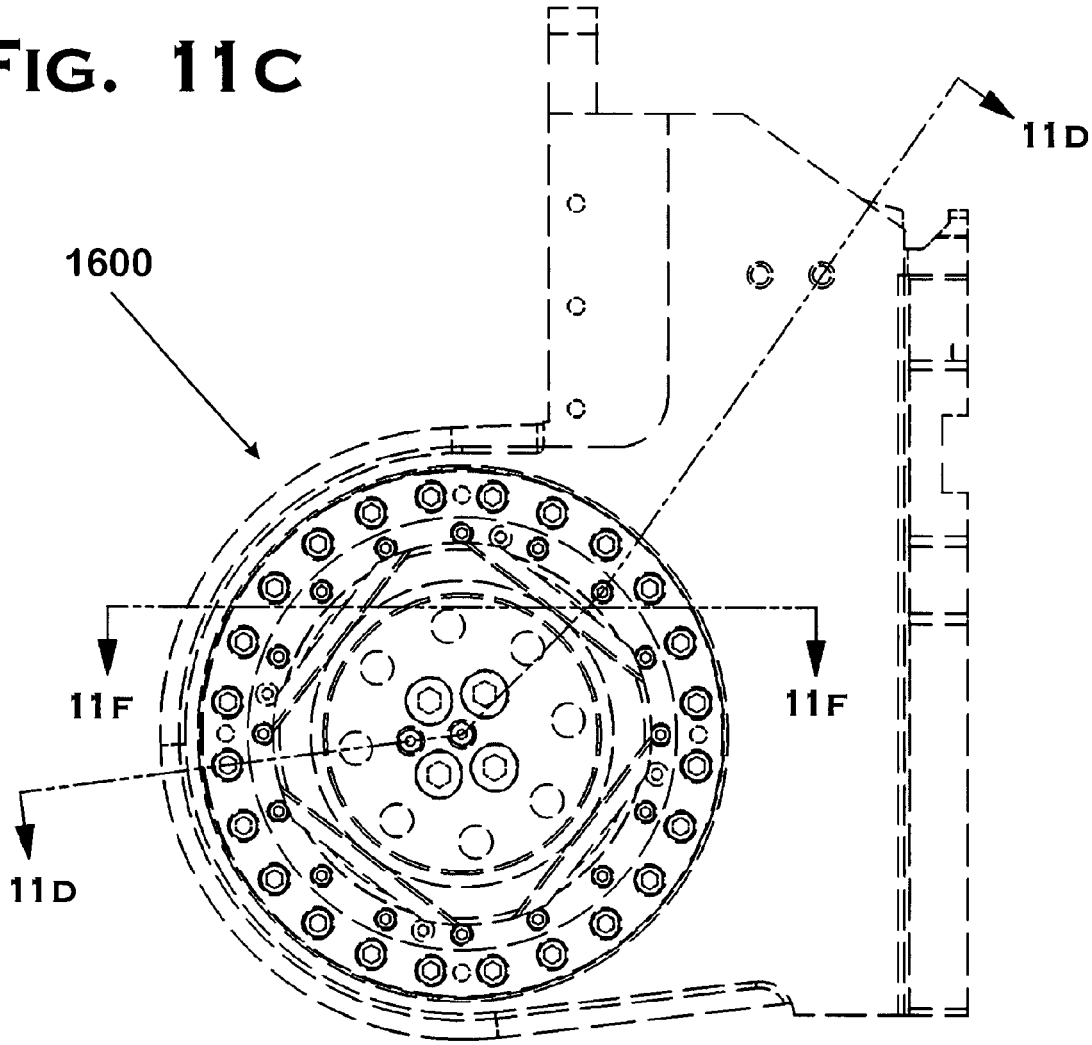
Figure 11E:
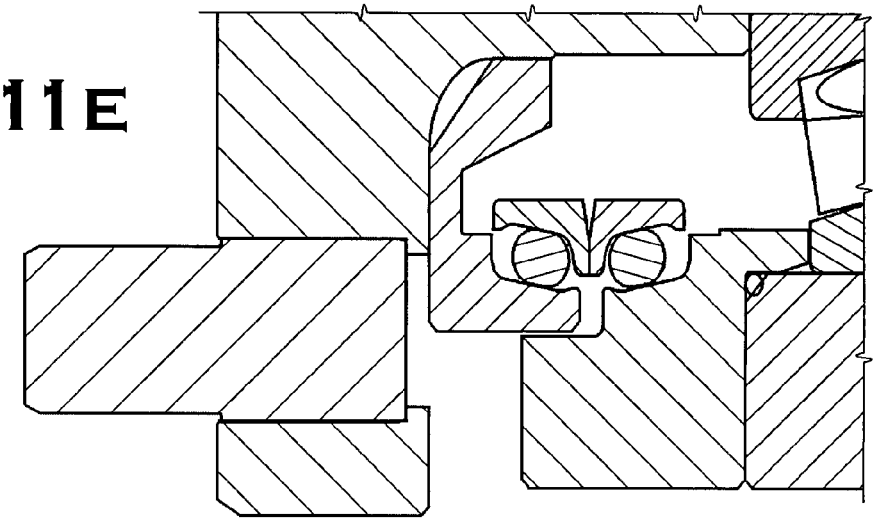
Figure 11D:
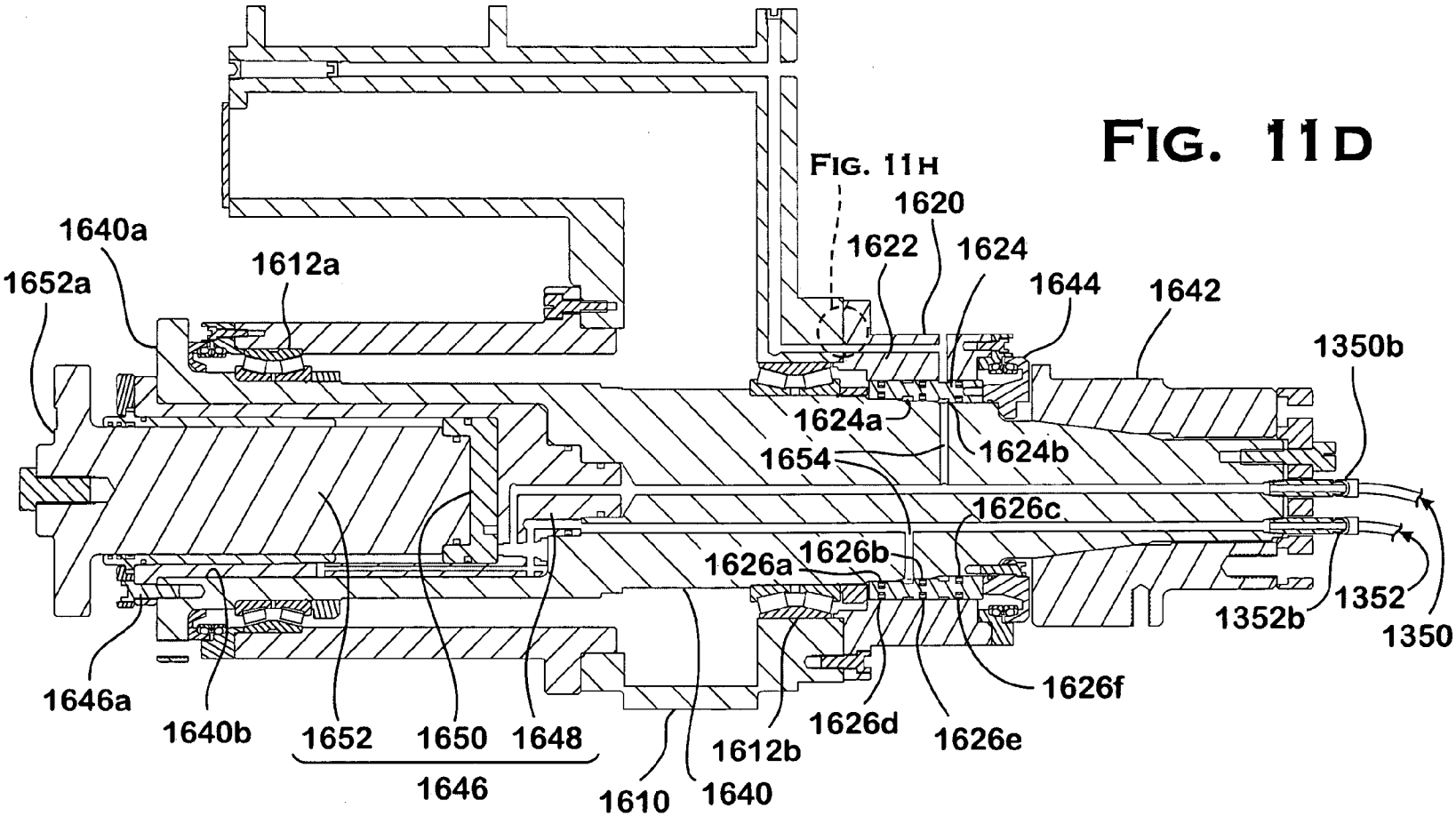

The three primary functions of the idler shaft 1640 will now be explained with continued reference to FIG. 11*d*. First, the idler shaft 1640 drivingly supports a right-hand end drum 1210 of the right-hand end drum section 1200. Second, a rotary union 1620 cooperates with the idler shaft 1640 to supply the hydraulic fluid required to operate the drum extensions 1250, 1450. And third, the idler shaft 1640 extensibly supports the right-hand end drum extension 1250 of the right-hand end drum section 1200.

Preferably, the idler shaft 1640 is formed with a fixture 1640*a*, e.g., a mounting flange, to which the right-hand end drum 1210 is secured, e.g., by bolts or other fasteners. The fixture 1640*a* is shown in FIG. 11*d* proximate an outboard end of the idler shaft 1640, but may be disposed at any suitable position along the idler shaft 1640. Preferably disposed at an inboard end of the idler shaft 1640 is a drive block 1642. The drive block 1642 is secured to the idler shaft 1640 and provides a mating surface so that driving torque may be transferred from the intermediate drum section 1300, via the idler shaft 1640 to the right-hand end drum 1210.

The rotary union 1620 includes a static portion 1622, which is preferably coupled to the housing 1610, and a sliding portion 1624 that is relatively movable with respect to at least one of the static portion 1622 and the idler shaft 1640. The sliding portion 1624 of the rotary union 1620 may include an annular spool that has a plurality (two are shown) of fluid passages 1624*a*, 1624*b* and a plurality (six are shown) of annular seals 1626*a* to 1626*f*. Preferably, each of the fluid passages 1624*a*, 1624*b* includes an internal circumferential groove, an external circumferential groove, and at least one passageway connecting the internal and external circumferential grooves. The annular seals are disposed between the sliding portion 1624, the housing 1610, and the idler shaft 1624 so as to isolate each internal/external pair of circumferential grooves. The rotary union 1620 facilitates transferring hydraulic fluid between a source of pressurized hydraulic fluid, preferably disposed on the mobile frame 22, to the hydraulic cylinders for operating the drum extensions 1250, 1450. Preferably, a seal system 1644 is axially disposed between the between the drive block 1642 and the rotary union 1620. The seal system 1644, which may include a mechanical face seal, is preferably coupled directly to the idler shaft 1640, i.e., as opposed to be coupled to the drive block 1642. If the drive block 1642 is unsecured and separated from the idler shaft 1640, access may be gained to inspect, service, or replace the seal system 1644; and if the seal system 1644 is unsecured and separated from the idler shaft 1640, access may be gained to inspect, service, or replace the rotary union 1620.

The third primary function of the idler shaft 1640, i.e., supporting the right-hand end drum extension 1250 for axial displacement between its extended and retracted configurations, is separately provided with respect to transferring driving torque to the right-hand end drum 1210. An axial bore 1640*b* in an outboard end of the idler shaft 1640 receives a hydraulic cylinder 1646. Preferably, the hydraulic cylinder 1646 is secured to the idler shaft 1640 by bolts or other fasteners 1646*a*, and thus the entire hydraulic cylinder 1646 may be replaced as a unit by removing the bolts 1646*a*. As is well understood, the hydraulic cylinder 1646 includes a cylinder body 1648 and a piston 1650, which per se is relatively rotatably disposed in the cylinder body 1648. The piston 1650 is preferably coupled by a piston rod 1652, which per se is also relatively rotatably disposed in the cylinder body 1648, to the right-hand end drum extension 1250. As shown in FIG. 11*d*, a fixture 1652*a*, e.g., a mounting flange, at an outboard end of the piston rod 1652 may be used to secure, e.g., by bolts or other fasteners, the right-hand end drum extension 1250 to the piston rod 1652. The hydraulic fluid required to displace the piston 1650 in the cylinder body 1648, and thereby extend or retract the right-hand end drum extension 1250, may be supplied to the cylinder body 1648 via conduits 1654 that extend through the idler shaft 1640 and are in fluid communication with the connect to the fluid passages 1624*a*, 1624*b* of the rotary union 1620.

As with the output and idler shafts 1540, 1640, many of the components may be interchangeable, including the drive blocks 1542, 1642, the seal systems 1544, 1644, the cylinder bodies 1548, 1648, the pistons 1550, 1650, and the piston rods 1552, 1652. By making many of the components interchangeable, i.e., making them substantially identical, manufacturing costs may be reduced, replacement part inventories may be reduced, etc.

Referring now to FIGS. 12*a* to 12*d*, details of the right-hand end drum 1210 will now be described. Main cylindrical bodies of the end drums 1210, 1410 may be manufactured substantially identically, but then the orientation and pattern of the cutting elements disposed thereon subsequently distinguish the right-hand end drum 1210 from the left-hand end drum 1410. Accordingly, for the purposes of the following description, the left-hand end drum 1410 may be assumed to be otherwise similar to the right-hand end drum 1210.

The right-hand end drum 1210 has an annular arrangement disposed around an axis of rotation R. The right-hand end drum 1210 includes a cylindrical body portion 1212 having an outer annular wall 1212*a* and an inner annular wall 1212*b*. The cutting elements are secured to and extend outwardly from the outer annular wall 1212*a* of the cylindrical body portion. The dashed lines in FIG. 12*c* indicate a cutting circle that is defined by the cutting elements when the end drum 1210 is rotated on the axis of rotation R.

Figure 12A:
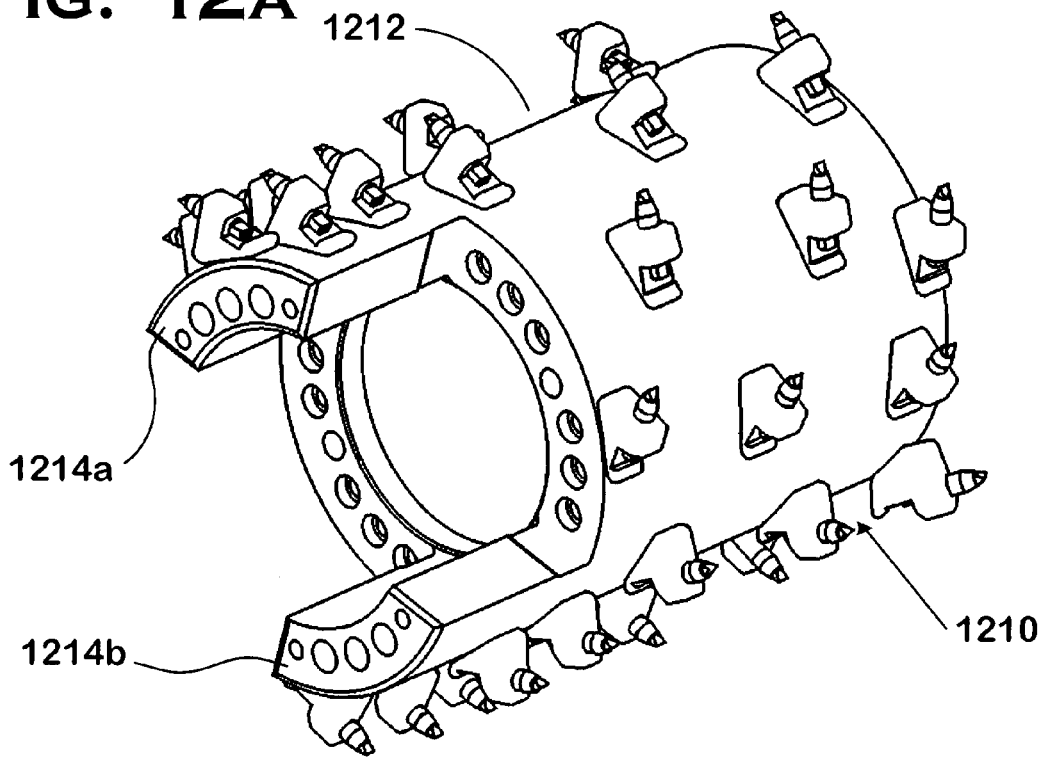
FIGS. 12*a* to 12*d* are schematic views of an end drum of the lower cutter drum assembly shown in FIGS. 9*a* to 9*o*.
Figure 12B:
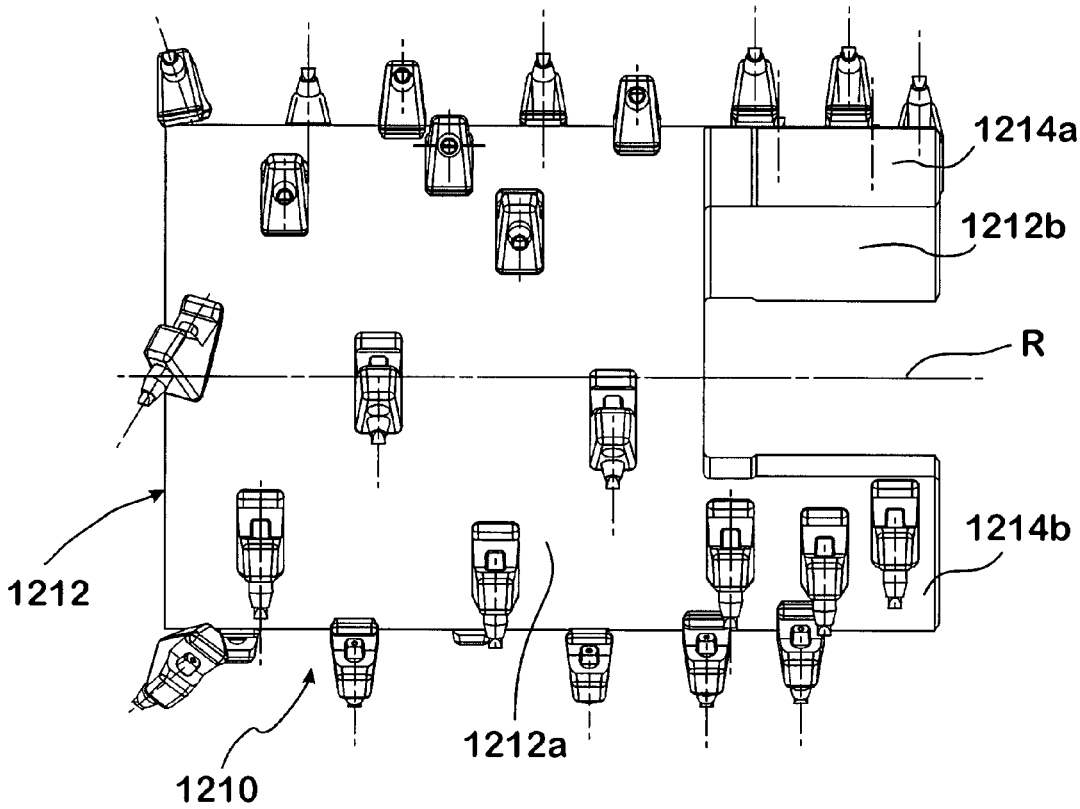
Figure 12C:
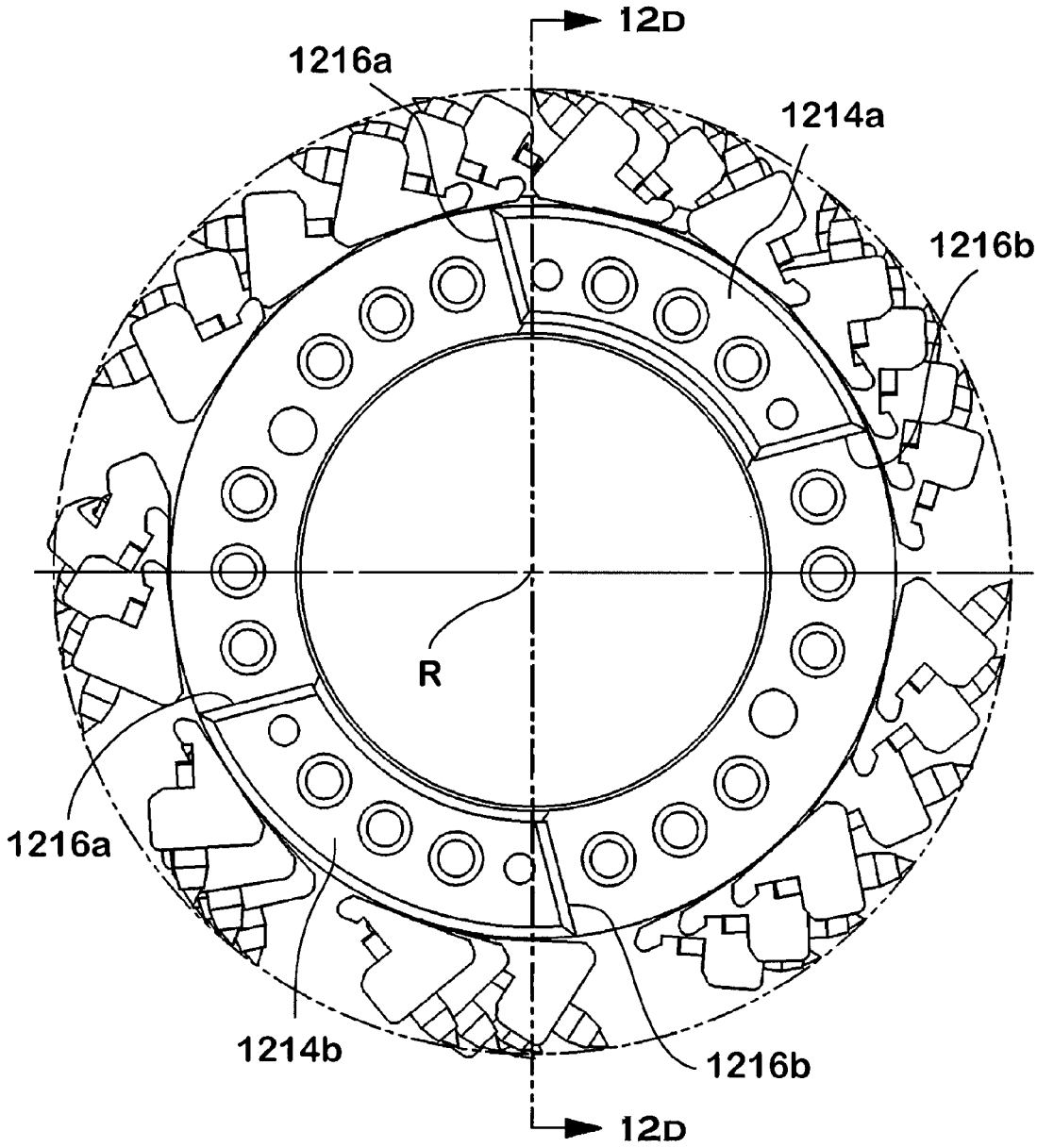
Figure 12D:
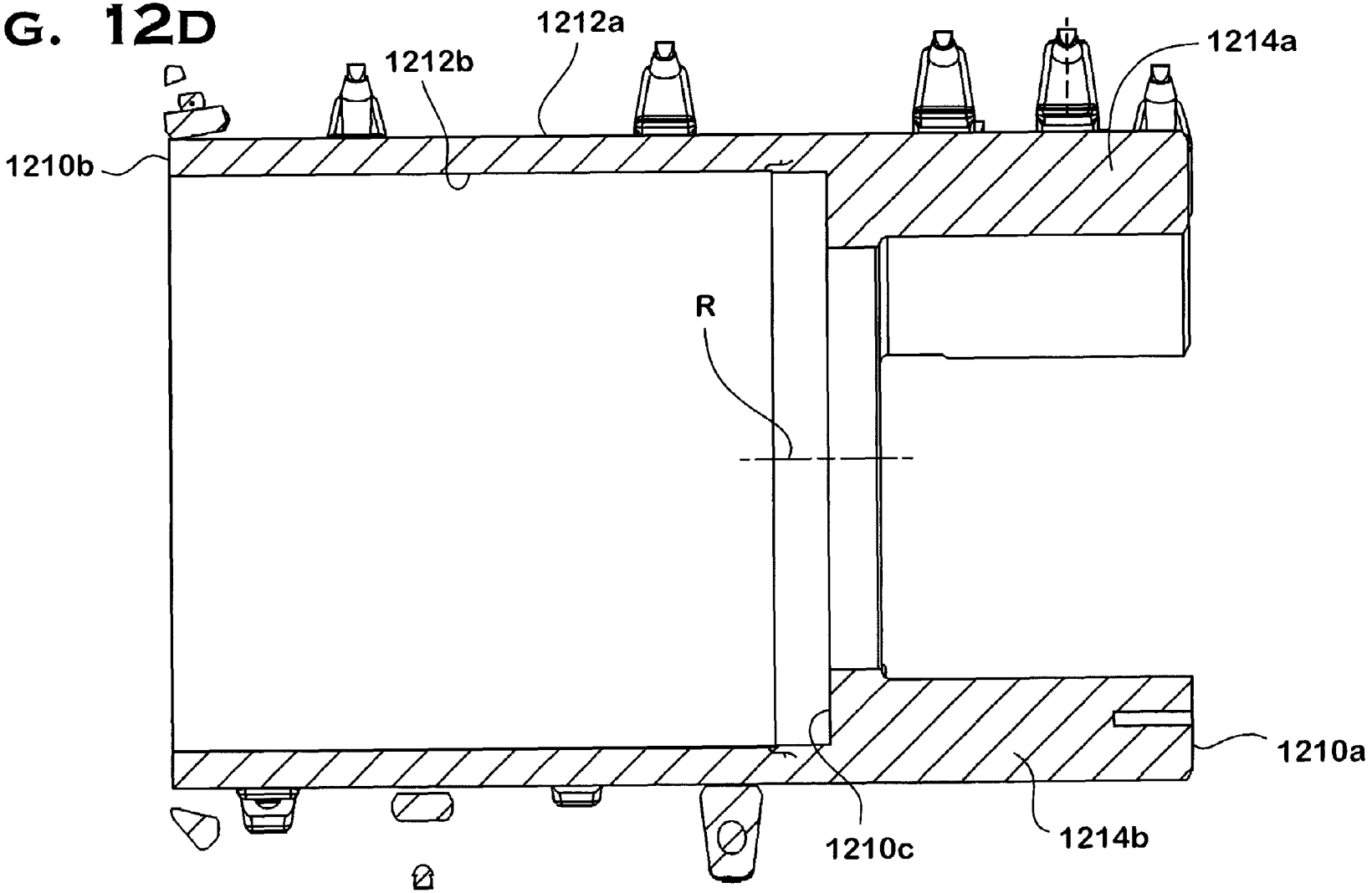

With particular reference to FIG. 12*d*, the outer annular wall 1212*a* preferably has a substantially constant outside diameter, whereas an inboard end 1210*a* of the inner annular wall 1212*b* has a larger inside diameter than an outboard end 1210*b* of the inner annular wall 1212*b*. Thus, the radial wall thickness of the end drum 1210 is greater at the outboard end 1210*b* than the inboard end 1210*a*. An axially facing surface 1212*c* extends radially inward from the inner annular wall 1212*b* and separates the different wall thicknesses of the end drum 1210. The surface 1210*c* matingly engages the fixture 1640*a* at the outboard end of the shaft 1640, and may be secured thereto by bolts or other fasteners.

The end drum 1210 is provided with arcuate segments of the outboard end 1210*b* omitted so as to leave at least one drum jaw 1214 projecting axially outboard. As shown in FIGS. 12*a* to 12*d*, two arcuate drum jaws 1214*a*, 1214*b* are symmetrically disposed around the axis of rotation R. The number, circumferential shape (provided that there is no undercutting), arcuate length, and axial length of the at least one jaw 1214 may all vary so long as the at least one jaw 1214 is suitable to transmit driving torque to the right-hand end drum extension 1250. Although it is envisioned that a single drum jaw may project axially outboard, it is desirable to include plural drum jaws that are disposed so as to provide generally balanced rotation of the end drum 1210 about the axis of rotation R.

Preferably, lateral faces 1216*a*, 1216*b* of each at least one jaw 1214 are hardened, e.g., by tempering or work hardening. Accordingly, the lateral faces 1216*a*, 1216*b* are suitable for forceful engagement, due to rotation about the axis of rotation R, with corresponding faces on the right-hand end drum extension 1250.

Referring now to FIGS. 13*a* to 13*d*, details of the right-hand end drum extension 1250 will now be described. Main bodies of the end drum extensions 1250, 1450 may be manufactured substantially identically, but then the orientation and pattern of the cutting elements disposed thereon subsequently distinguish the right-hand end drum extension 1250 from the left-hand end drum extension 1450. Accordingly, for the purposes of the following description, the left-hand end drum extension 1450 may be assumed to be otherwise similar to the right-hand end drum extension 1250.

The right-hand end drum extension 1250 has an annular arrangement that is also disposed around the axis of rotation R. The right-hand end drum extension 1250 includes at least one arcuate segment of a cylindrical body portion 1252 and which defines a partial outer annular wall 1252*a* and a partial inner annular wall 1252*b*.

Figure 13A:
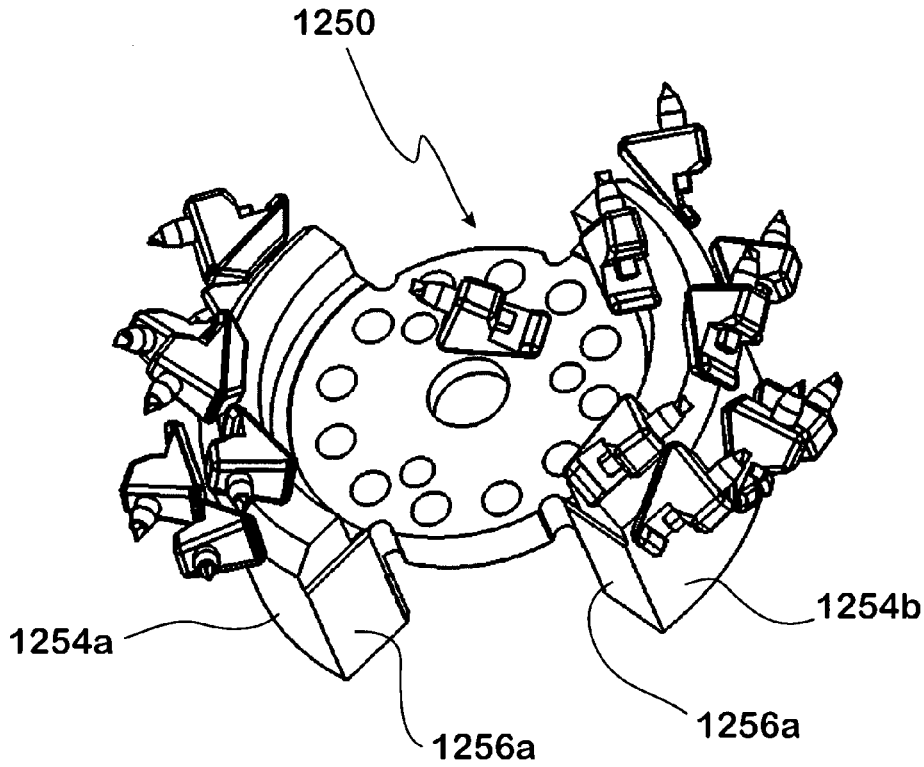
FIGS. 13*a* to 13*d* are schematic views of an end drum extension of the lower cutter drum assembly shown in FIGS. 9*a* to 9*o*.
Figure 13D:
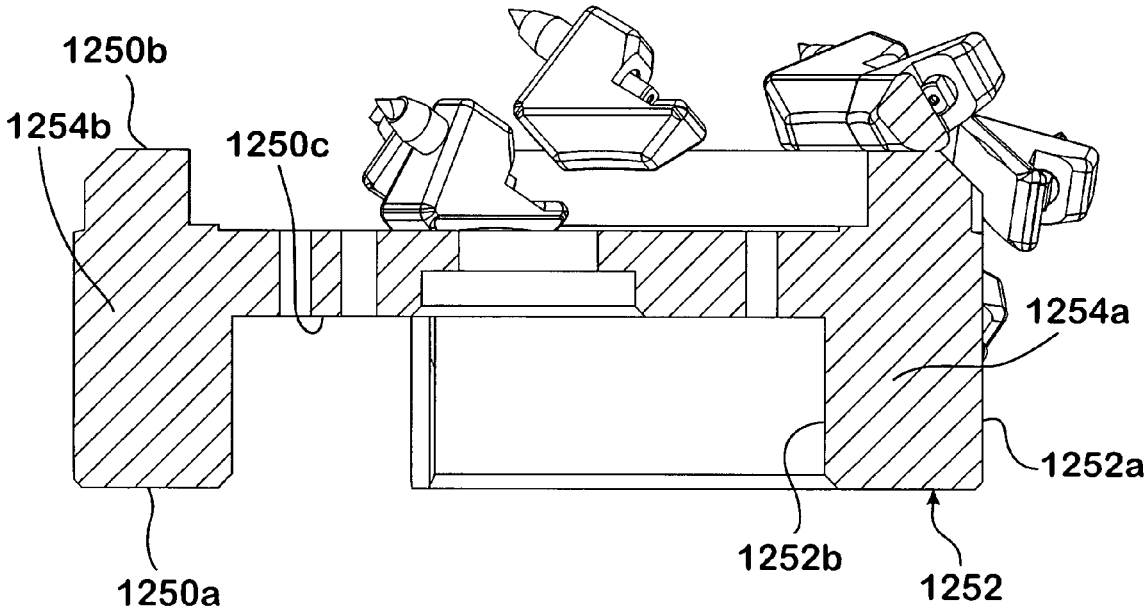
Figure 13C:
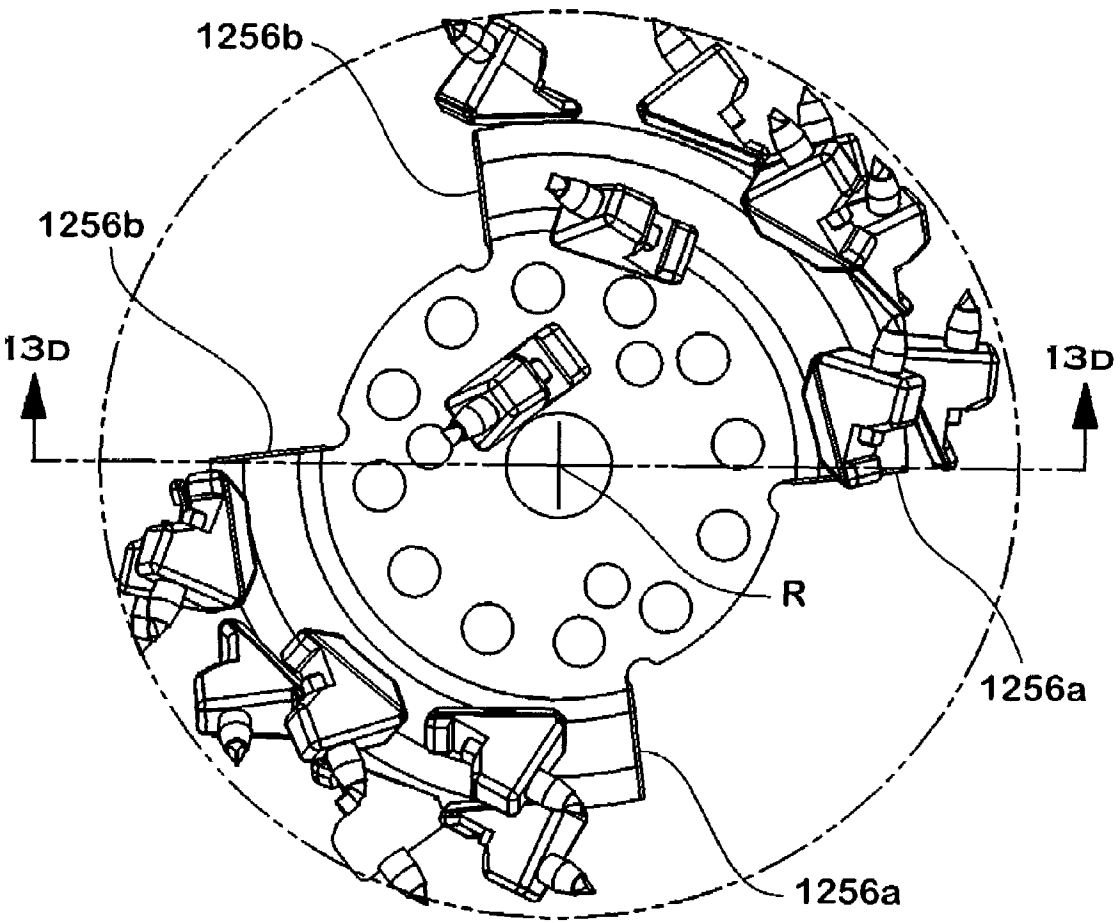
Figure 13B:
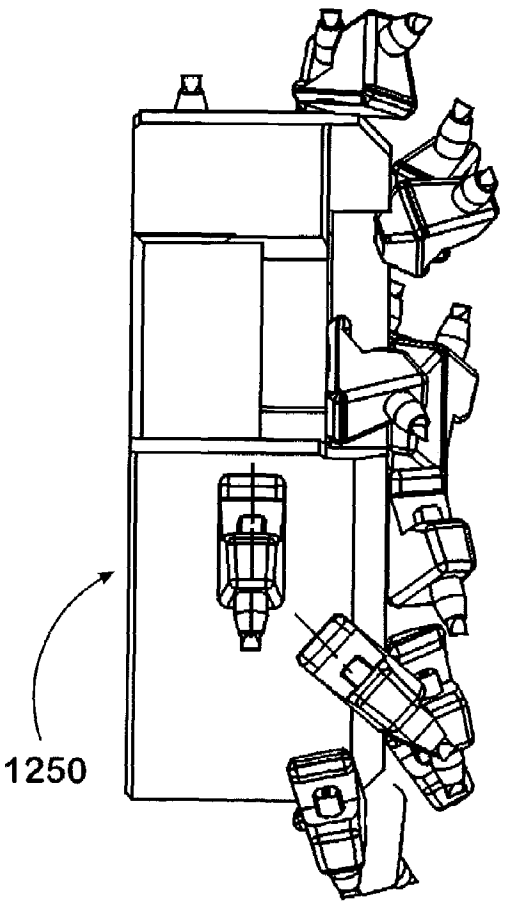

With particular reference to FIG. 13*d*, the partial outer annular wall 1252*a* preferably has a substantially constant outside diameter, whereas an inboard end 1250*a* of the partial inner annular wall 1252*b* may have a smaller inside diameter than an outboard end 1250*b* of the partial inner annular wall 1252*b*. Thus, the radial wall thickness of the right-hand end drum extension 1250 may be less at the outboard end 1250*b* than the inboard end 1250*a*. An axially facing flange 1250*c* is fixed to the inner annular wall 1252*b* and may separate the different wall thicknesses of the right-hand end drum extension 1250. The flange 1250*c* matingly engages the fixture 1652*a* of the piston rod 1652, and may be secured thereto by bolts or other fasteners.

The at least one arcuate segment of the cylindrical body portion 1252 provides at least one drum extension jaw 1254 that projects axially inboard. As shown in FIGS. 13*a* to 13*d*, two arcuate drum extension jaws 1254*a*, 1254*b* are symmetrically disposed around the axis of rotation R. The number, circumferential shape (provided that there is no undercutting), arcuate length, and axial length of the at least one drum extension jaw 1254 may all vary so long as the at least one drum extension jaw 1254 is suitable to receive driving torque from the right-hand end drum 1210. Although it is envisioned that a single drum extension jaw may project axially inboard, it is desirable to include plural drum extension jaws that are disposed so as to provide generally balanced rotation of the end drum extension 1250 about the axis of rotation R.

Preferably, lateral faces 1256*a*, 1256*b* of each at least one jaw 1254 are hardened, e.g., by tempering or work hardening. Accordingly, the lateral faces 1256*a*, 1256*b* are suitable for forceful engagement, due to rotation about the axis of rotation R, with the lateral faces 1216*a*, 1216*b* on the right-hand end drum 1210.

Cutting elements are secured to and extend outwardly from the partial outer annular wall 1252*a* of the at least one arcuate segment of cylindrical body portion, and may also be secured to and extend outwardly from the flange 1250*c*. The dashed lines in FIG. 13*c* indicate a cutting circle that is defined by the cutting elements when the right-hand end drum extension 1250 is rotated on the axis of rotation R.

The hydraulic cylinder arrangement 1646 in the idler shaft 1640 displaces the right-hand end drum extension 1250 axially between the extended and retracted configurations, i.e., such that there is relative axial sliding between the lateral faces 1216*a*, 1216*b*, 1256*a*, 1256*b*. And the right-hand end drum 1210 rotationally drives the right-hand end drum extension 1250 around the axis of rotation R, i.e., due to forceful contact between the lateral faces 1216*a*, 1216*b*, 1256*a*, 1256*b*. Thus, separate forces are provided for transferring torque and for extending/retracting the extension drum with respect to the drum.

Referring now to FIGS. 14*a* to 14*j*, details of the intermediate drum section 1300 will now be described. The intermediate drum section 1300 includes a cylindrical body portion formed by a plurality (two are shown) of intermediate drum housing portions 1310*a*, 1310*b*. Preferably, the intermediate drum housing portions 1310*a*, 1310*b* are bolted in a conventional manner to one another so as to define a hollow tube. The number and arcuate length of the intermediate drum housing portions may all vary so long as the intermediate drum section 1300 is suitable for transferring driving torque from the output shaft 1540 to the idler shaft 1640. Additionally, it is desirable for the intermediate drum section 1300, as a unit, to be generally balanced rotationally about the axis of rotation R.

Figure 14A:
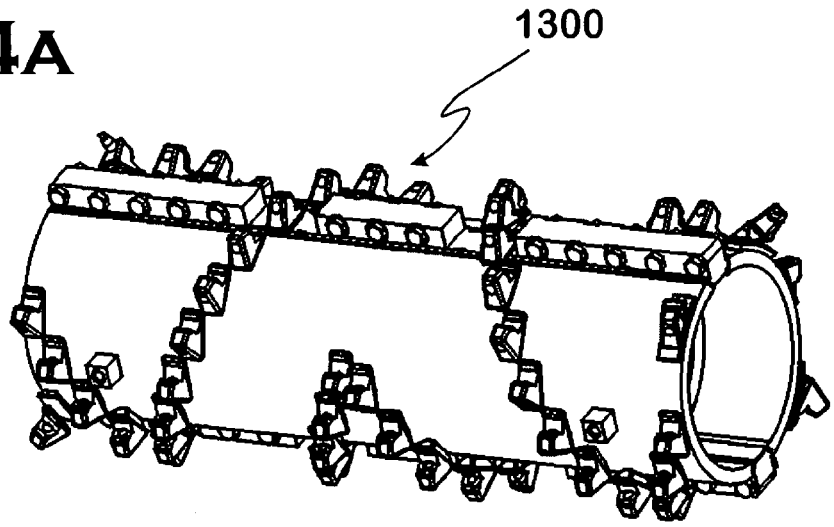
FIGS. 14*a* to 14*i* are schematic views of an intermediate drum of the lower cutter drum assembly shown in FIGS. 9*a* to 9*o*.
Figure 14C:
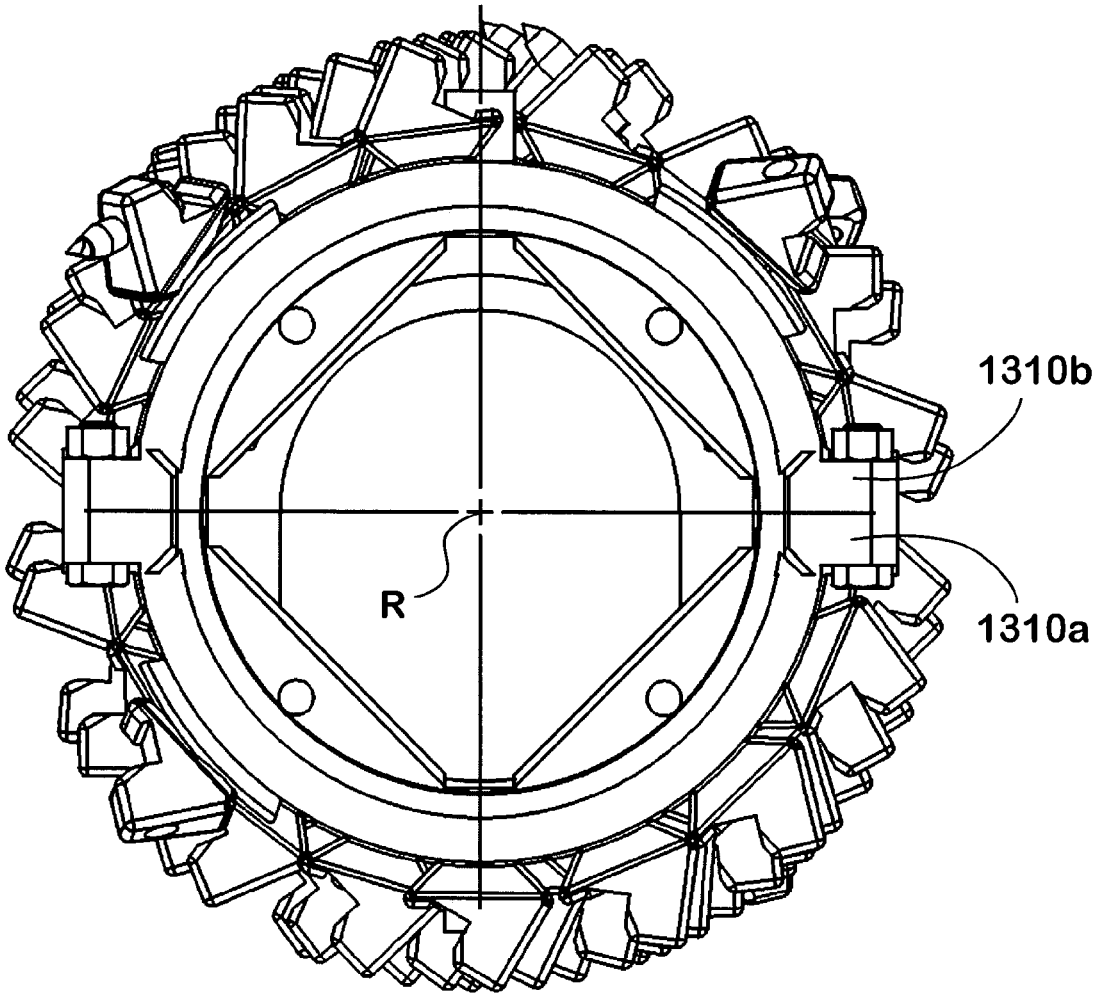
Figure 14B:
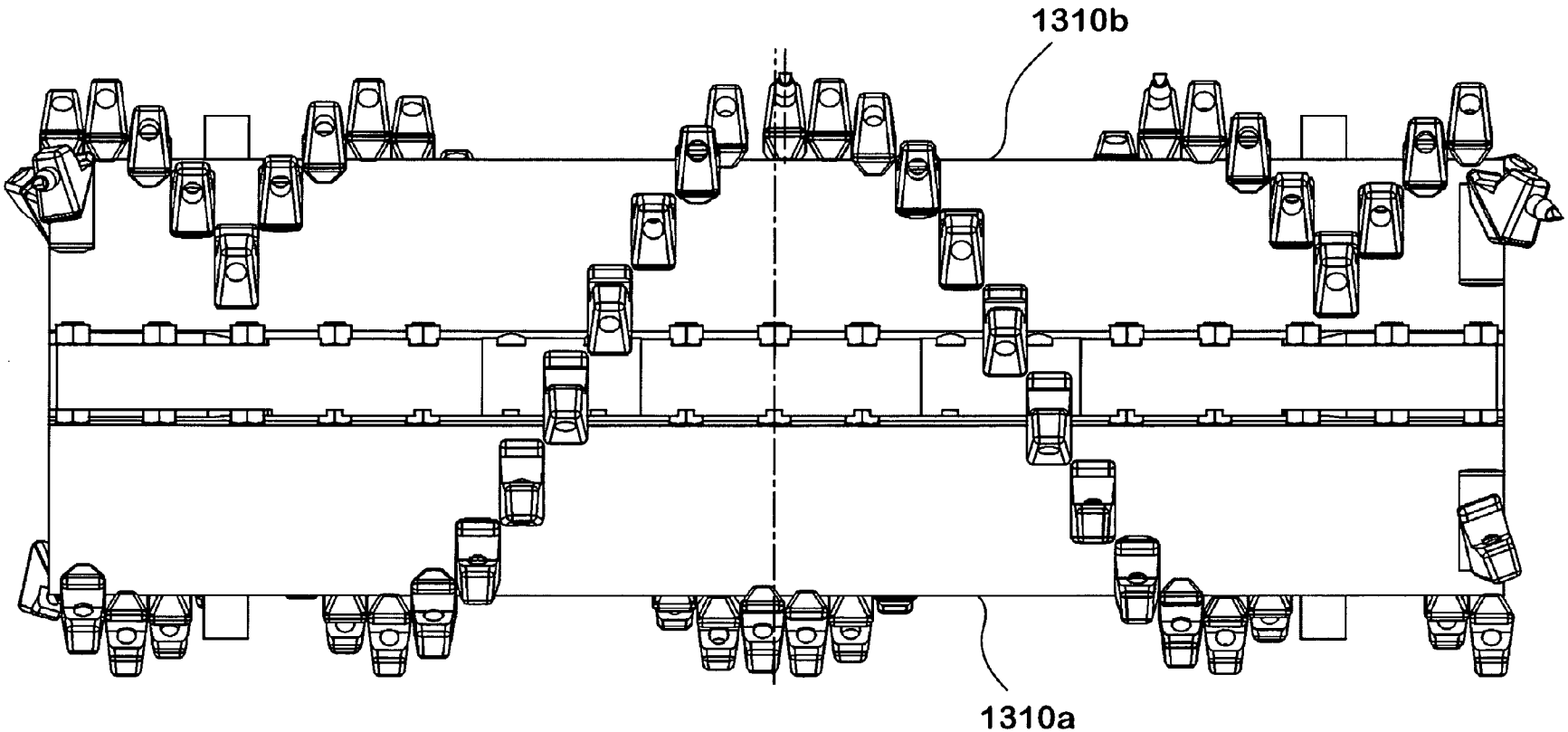
Figure 14D:
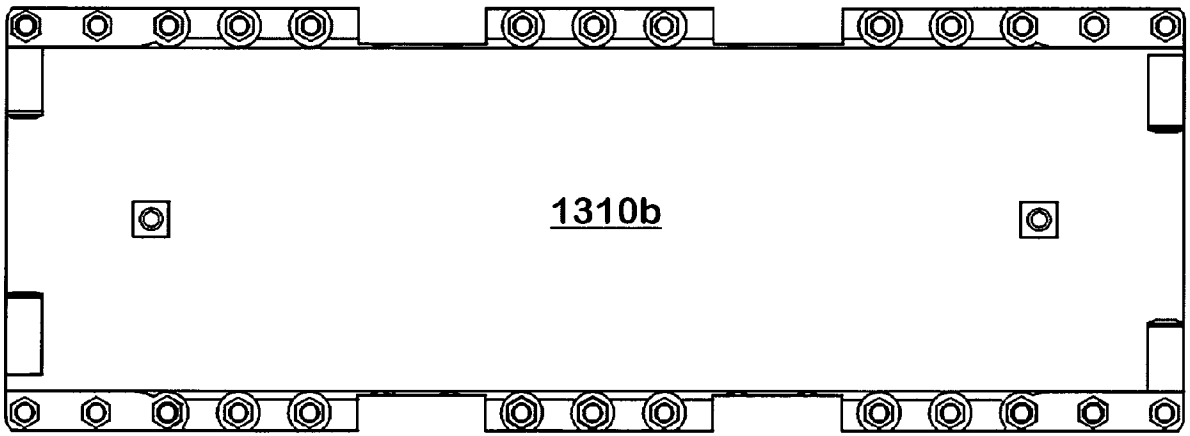
Figure 14E:
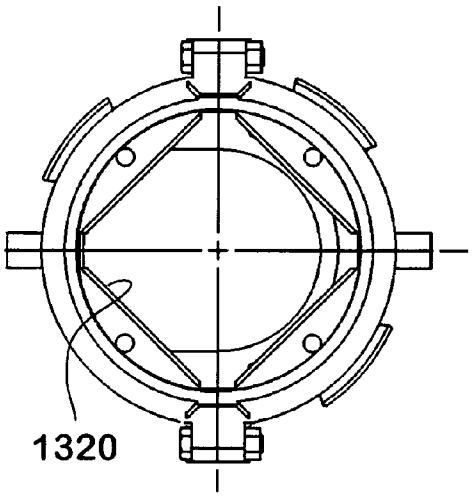
Figure 14F:
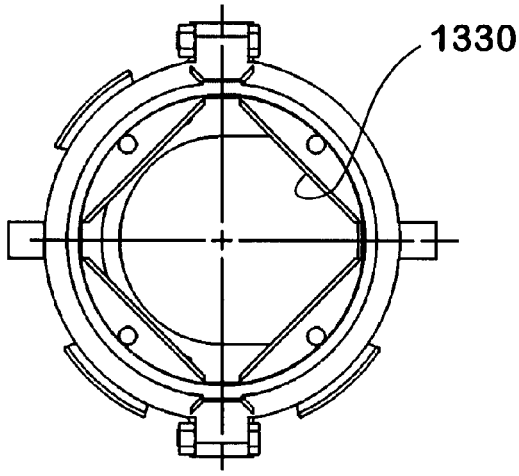

The interior surface of the intermediate drum section 1300 preferably defines mating surfaces 1320, 1330 to cooperatively engage the drive blocks 1542, 1642, respectively. For example, as shown in FIGS. 14*e* and 14*f*, each of the surfaces 1320, 1330 defines a square opening, and portions of the drive blocks 1542, 1642 each have generally square cross-sections (e.g., see FIG. 10*a*). It is also envisioned that the mating surfaces 1320, 1330 may define different shape openings and the drive blocks 1542, 1642 may have corresponding different shape cross-sections. Additionally, small differences (e.g., approximately 0.030-0.040 inch) in the size of the openings relative to the size of the cross-sections may provide a tolerance for misalignment between the drive blocks 1542, 1642.

Cutting elements are secured to and extend outwardly from the intermediate drum section 1300. Generally, the diameter of a cutting circle that is defined by the cutting elements when the intermediate drum section 1300 is rotated on the axis of rotation R is generally the same as the diameter of the cutting circles of the right-hand and left-hand drum sections 1200, 1400.

The intermediate drum section 1300 is axially spaced from the right-hand drum section 1200 by a portion of the drive block 1642 for the idler assembly 1600. Similarly, the intermediate drum section 1300 is axially spaced from the left-hand drum section 1400 by a portion of the drive block 1542 for the drive assembly 1500.

Preferably, replaceable hydraulic hoses 1350, 1352 provide fluid communication between the conduits 1554 in the output shaft 1540 and conduits 1654 in the idler shaft 1640. The hydraulic hoses 1350, 1352, which are preferably disposed in the hollow tube defined by the intermediate drum section 1300, include first couplings 1350*a*, 1352*a* with the conduits 1554 and include second couplings 1350*b*, 1352*b* with the conduits 1654. Thus, a single pair of fluid passages 1624*a*, 1624*b* in the rotary union 1620 may be used to identically and simultaneously control the extension or retraction of the right-hand and left-hand drum extensions 1250, 1450.

Alternatively, additional fluid passages in the rotary union 1620 and additional, separate conduits in the idler shafts 1540 may be coupled in fluid communication, via the replaceable hydraulic hoses 1350, 1352, to the conduits 1554 in the output shaft 1540 to independently control the extension or retraction of the right-hand and left-hand drum extensions 1250, 1450. Moreover, an additional rotary union (not shown) may be disposed in the housing 1510 for fluid communication directly with the conduits 1554 in the output shaft 1540, thereby eliminating the need for the hydraulic hoses 1350, 1352.

If the intermediate drum housing portions 1310*a*, 1310*b* are unsecured, e.g., unbolted, then separated from one another, and individually removed, access may be gained to the replaceable hydraulic hoses 1350, 1352 and to the inboard ends of the output and idler shafts 1540, 1640. Then, as discussed above, further access may be gained to inspect, service, or replace the rotary union 1620 and the inboard seal systems 1544, 1644.

Figure 14G:
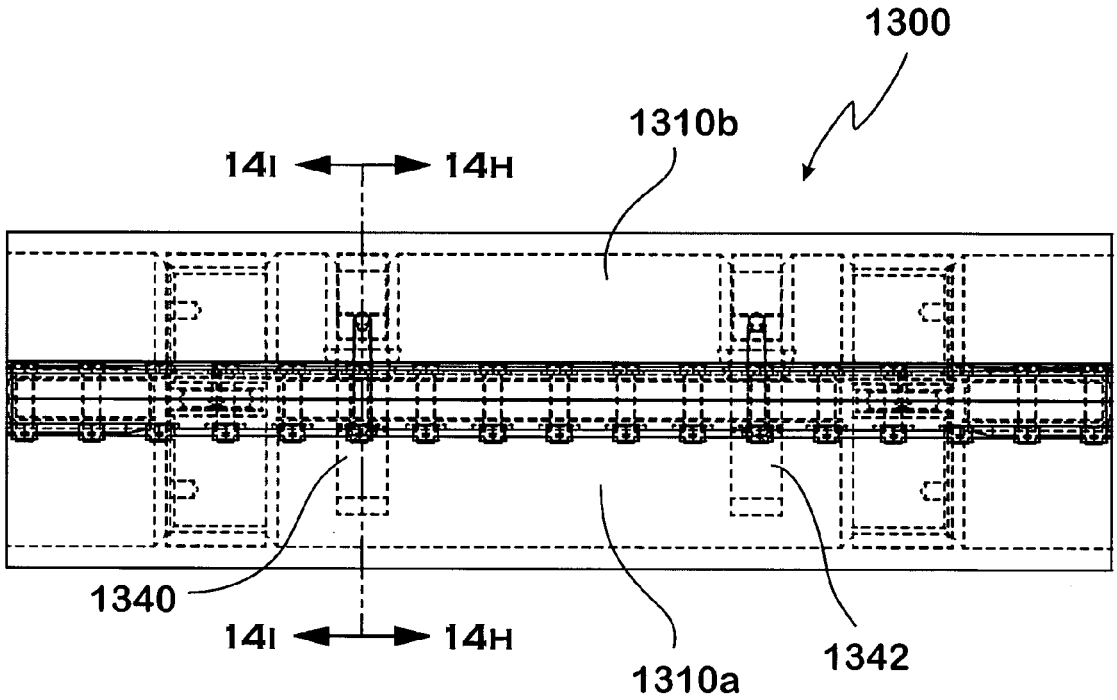
Figure 14H:
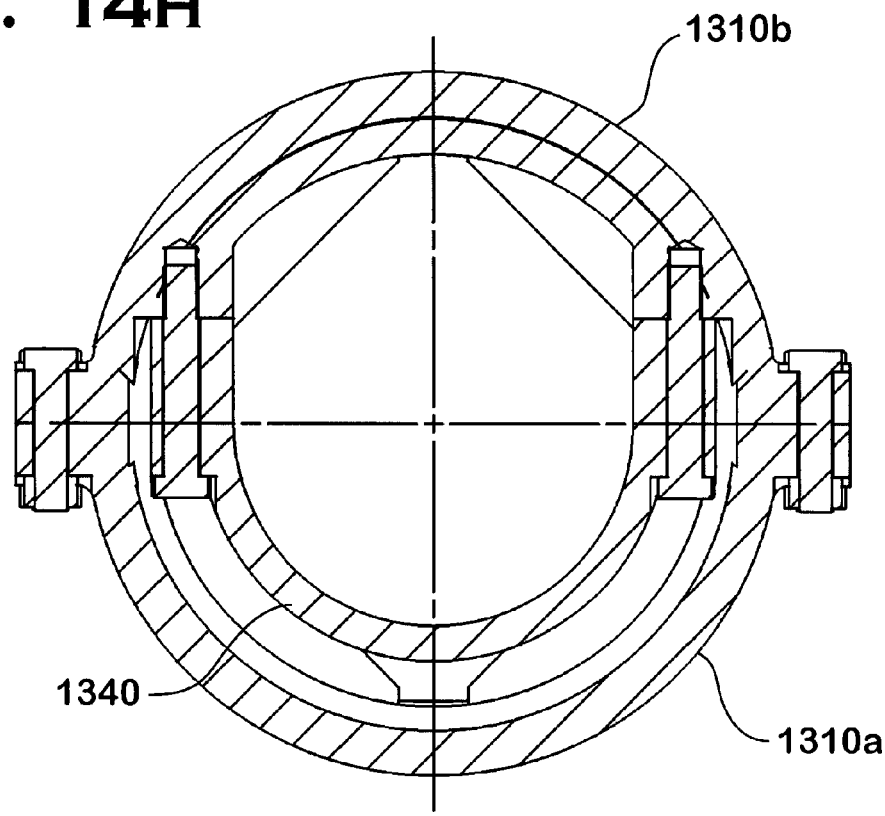
Figure 14I:
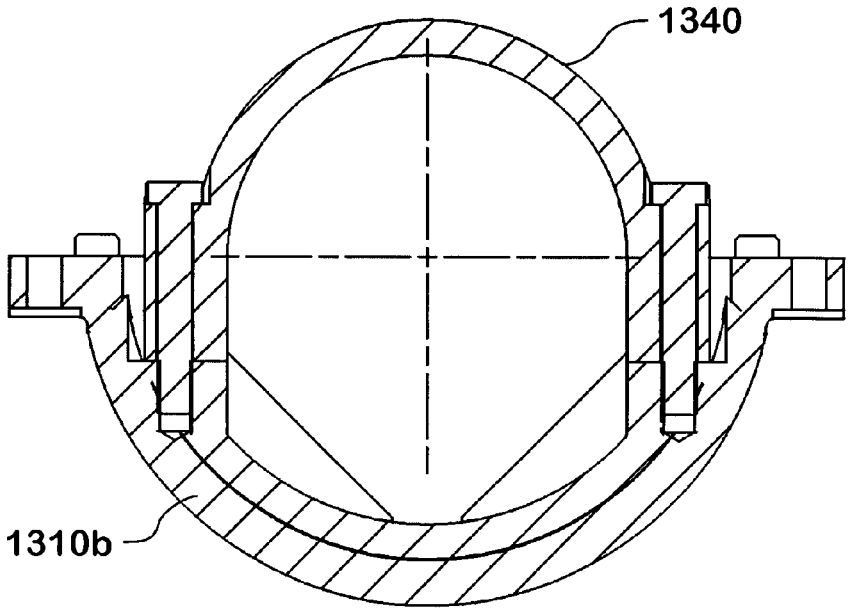
Figure 14J:
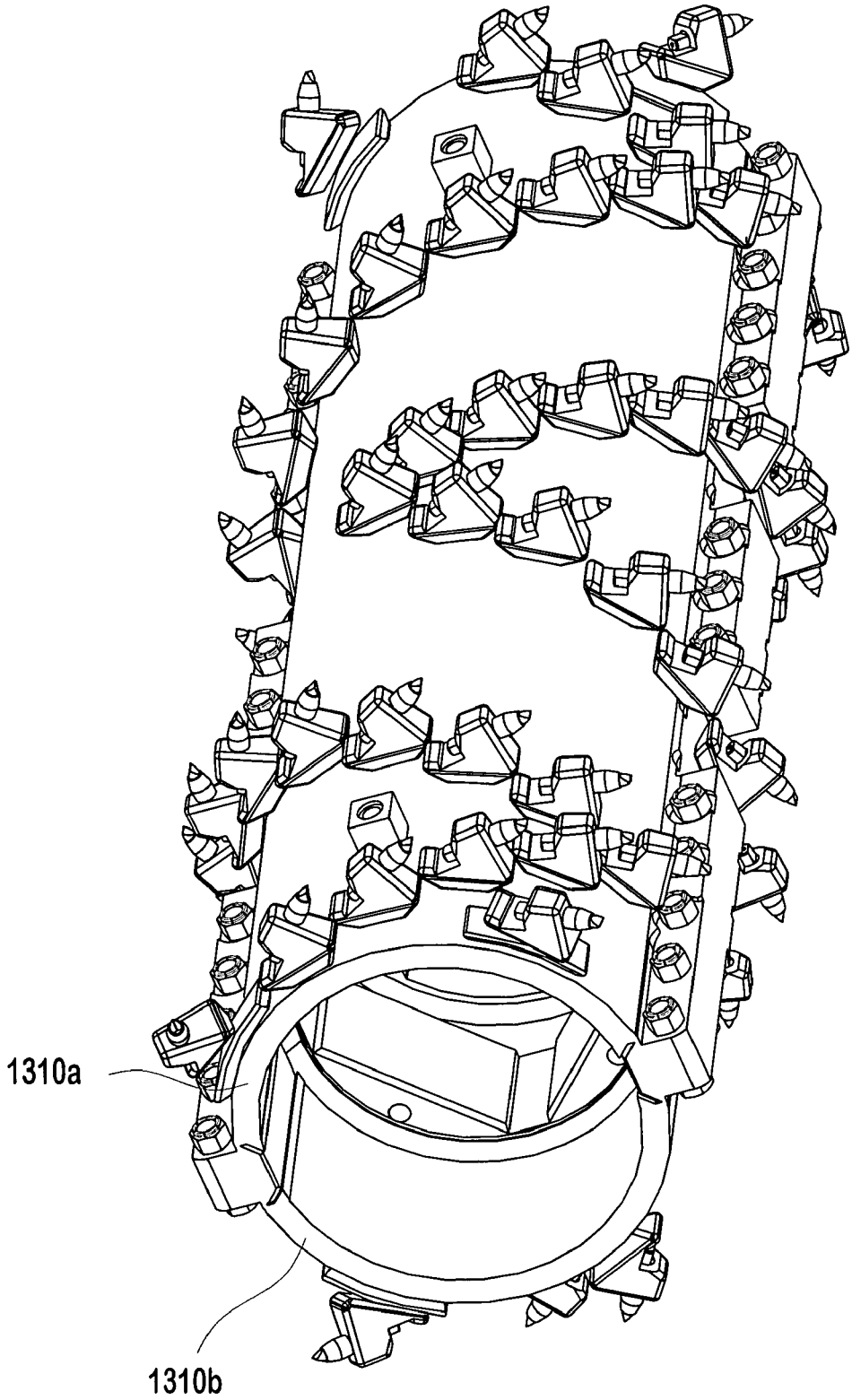
FIG. 14*j* is a photograph of the intermediate drum assembly shown in FIGS. 14*a* to 14*i*.

Referring particularly to FIGS. 14*g* to 14*i*, a preferred disassembly procedure for the intermediate drum section 1300 will now be described. Initially, a first one of the intermediate drum housing portions 1310*a*, 1310*b* is positioned so as to be able to drop down, i.e., with a parting seam between the intermediate drum housing portions 1310*a*, 1310*b* horizontally oriented (see FIG. 14*h*). Next, the bolts or other fasteners securing together the intermediate drum housing portions 1310*a*, 1310*b* are removed. If the lower of the intermediate drum housing portions 1310*a*, 1310*b* does not drop away, then it is necessary to at least partially re-secure together the intermediate drum housing portions 1310*a*, 1310*b*, and then rotate the intermediate drum section 1300 180° about the axis of rotation R. This is because a first one of the intermediate drum housing portions 1310*a*, 1310*b* is secured only to the second one of the intermediate drum housing portions 1310*a*, 1310*b*, whereas the second one of the intermediate drum housing portions 1310*a*, 1310*b* remains supported by clamps 1340, 1342 with respect to the drive blocks 1542, 1642, respectively. For example, beginning with the intermediate drum 1300 positioned as shown in FIG. 14*h*, the intermediate drum housing portion 1310*a* will drop away from the intermediate drum housing portion 1310*b* when the intermediate drum housing portions 1310*a*, 1310*b* are unbolted. Then the intermediate drum housing portion 1310*b* can be rotated 180° to the position shown in FIG. 14*i*, with the clamps 1340, 1342 maintaining support for the intermediate drum housing portion 1310*b* with respect to the drive blocks 1542, 1642. Then, clamps 1340, 1342 may be released with respect to the intermediate drum housing 1310*b*, and the intermediate drum housing portion 1310*b* will drop away from the drive blocks 1542, 1642. Reassembly is the reverse of the aforementioned disassembly procedure.

There are a number of features and advantages provided by boring machines as described above. For example, by providing the extension/retraction pistons operating in the hydraulic cylinders disposed along the axis of rotation, it is possible to separate the forces for transferring torque and for extending/retracting the extension drums with respect to the drums, and to increase the amount of telescopic axial overlap. Accordingly, this provides a more robust system without necessitating a larger diameter lower cutter bar and without increasing the number of telescopic pieces that must be concentrically disposed about the axis of rotation.

There are also a number of modifications that are envisioned. For example, another external source of pressurized hydraulic fluid may be alternatively or additionally used for extending/retracting the extension drums with respect to the drums. The additional source may be connected directly to each of the hydraulic cylinders, e.g., via fluid connections through the respective right-hand and left-hand drum sections, only when extension or contraction is needed while the boring machine is not operating. Such an arrangement may eliminate the rotary union and the conduits in the output and idler shafts or, with a suitable hydraulic circuit, may provide a redundant backup system in the event that the rotary union was to fail. The additional source may be preferable for a low number of duty cycles, i.e., extending and contracting the drum extensions, or to index the cutter drum, e.g., servicing, etc.

Another modification that is envisioned is providing a mechanical stop(s) to lock the position of the drum extensions with respect to the drums. The mechanical stop(s), e.g., blocks to maintain the extended configuration of the drum extensions, could be bolted in place so that the pressure in the hydraulic system, e.g., hydraulic cylinders, rotary union, etc., could be released. At such time as it is again necessary to reconfigure the drum extensions, the mechanical stop(s) could be unsecured and removed.

While the invention has been disclosed with reference to certain preferred embodiments, numerous modifications, alterations, and changes to the described embodiments are possible without departing from the sphere and scope of the invention, as defined in the appended claims and equivalents thereof. Accordingly, it is intended that the invention not be limited to the described embodiments, but that it have the full scope defined by the language of the following claims.

The invention claimed is:

1. A mining machine comprising, a mobile frame including a front end portion;

a plurality of rotor assemblies including a plurality of rotor cutter arms, the plurality of rotor assemblies being disposed in spaced relation on the front end portion of the mobile frame;

a cutter drum assembly disposed forwardly of the front end portion, the cutter drum assembly including:

an axis of rotation disposed transversely across the front end portion of the mobile frame;

a first end drum section including:

a first shaft extending along the axis of rotation, the first shaft including a first bore extending along the axis of rotation;

a first end drum being secured to the first shaft;

a first end drum extension disposed coaxially about the axis of rotation;

a first piston being relatively rotatably disposed in the first bore and being fixed with respect to the first end drum extension, the first piston being displaceable along the axis of rotation between an extended configuration of the first end drum extension and a retracted configuration of the first end drum extension;

a first coupling transferring torque between the first end drum and the first end drum extension;

a second end drum section including:

a second shaft extending along the axis of rotation and being axially spaced from the first shaft, the second shaft including a second bore extending along the axis of rotation;

a second end drum being secured to the second shaft;

a second end drum extension disposed coaxially about the axis of rotation;

a second piston being relatively rotatably disposed in the second bore and being fixed with respect to the second end drum extension, the second piston being displaceable along the axis of rotation between an extended configuration of the second end drum extension and a retracted configuration of the second end drum extension;

a second coupling transferring torque between the second end drum and the second end drum extension; and an intermediate drum section being disposed coaxially with the axis of rotation and extending between the first and second shafts, wherein the first and second couplings each comprise an axially sliding coupling, and each axially sliding coupling comprises first and second sets of jaws, each of the first sets of jaws is disposed on a corresponding one of the first and second end drums, and each of the second sets of jaws is disposed on a respective corresponding one of the first and second end drum extensions.

2. The mining machine of claim 1, wherein each axially sliding coupling comprises alternating jaws from the first and second sets of jaws, and the alternating jaws define a circumferential surface disposed around the axis of rotation.

3. The mining machine of claim 1, wherein the first and second sets of jaws comprise hardened mating faces.

4. The mining machine of claim 1, wherein the first bore and the first piston define a first hydraulic cylinder, and the second bore and the second piston define a second hydraulic cylinder.

5. The mining machine of claim 4, wherein the first and second hydraulic cylinders are operably coupled so that the extended configurations of the first and second end drum extensions are in response to a first hydraulic signal, and so that the retracted configurations of the first and second end drum extension are in response to a second hydraulic signal.

6. The mining machine of claim 1, further wherein the cutter drum assembly comprises:

a first support being disposed between the first end and intermediate drum sections, the first support including:

a first housing relatively rotatably supporting the first shaft with respect to the mobile frame; and a drive assembly being adapted to apply torque to the first shaft; and a second support being disposed between the second end and intermediate drum sections, the second support including:

a second housing relatively rotatably supporting the second shaft with respect to the mobile frame; and a rotary union being adapted to supply hydraulic fluid to the second bore from a hydraulic pressure source.

7. The mining machine of claim 6, wherein the drive assembly comprises a first set of gears including:

a ring gear being coaxial with the axis of rotation and being secured to the first shaft; and a pinion cooperatively engaging the ring gear.

8. The mining machine of claim 7, wherein the drive assembly comprises a second set of gears including:

a first bevel gear being fixed with respect to the pinion; and a second bevel gear cooperatively engaging the first bevel gear, the second bevel gear being coupled to a driveshaft arrangement adapted to convey torque to the cutter drum assembly from a torque source.

9. The mining machine of claim 6, wherein the rotary union comprises a static portion being secured to the second housing and a sliding portion movable with respect to at least one of the static portion and the second shaft.

10. The mining machine of claim 9, wherein the sliding portion of the rotary union comprises:

a first fluid passage supplying a first hydraulic signal to displace the second end drum extension toward the extended configuration; and a second fluid passage supplying a second hydraulic signal to the second bore so as to displace the second piston toward the retracted configuration of the second end drum extension.

11. The mining machine of claim 10, wherein the second shaft comprises:

a first set of conduits providing fluid communication between the first fluid passage of the rotary union and a first portion of the second bore, the first portion of the second bore being partially defined by a first side of the second piston; and a second set of conduits providing fluid communication between the second fluid passage of the rotary union and a second portion of the second bore, the second portion of the second bore being partially defined by a second side of the second piston.

12. The mining machine of claim 11, wherein the first shaft comprises:

a third set of conduits providing fluid communication between the first set of conduits and a first portion of the first bore, the first portion of the first bore being partially defined by a first side of the first piston, and the third set of conduits supplying the first hydraulic signal to displace the first end drum extension toward the extended configuration; and a fourth set of conduits providing fluid communication between the set of conduits and a second portion of the second bore, the second portion of the second bore being partially defined by a second side of the second piston, and the fourth set of conduits supplying the second hydraulic signal to displace the first end drum extension toward the retracted configuration.

13. The mining machine of claim 12, further comprising:

a first exchangeable conduit connecting the first and third sets of conduits;

a second exchangeable conduit connecting the second and fourth sets of conduits.

14. The mining machine of claim 13, wherein the intermediate drum section comprises a hollow tube, and the first and second exchangeable conduits extend through the hollow tube.

15. The mining machine of claim 1, wherein the intermediate drum section transfers torque between the first and second end drum sections.

16. The mining machine of claim 15, wherein the intermediate drum section comprises a plurality of segments defining an outer circumferential surface disposed around the axis of rotation.

17. The mining machine of claim 16, further comprising:

a first drive block disposed between and rotationally coupling the first shaft and the intermediate drum section; and a second drive block disposed between and rotationally coupling the second shaft and the intermediate drum section.

18. The mining machine of claim 1, further comprising:

at least one door being supported on the mobile frame and pivoting between open and closed positions, the at least one door being disposed in the open position in response to the extended configuration of at least one of the first and second end drum extensions, and the at least one open door being disposed in the closed position in response to the retracted configuration of the at least one of the first and second end drum extensions.

* * * * *